US007967951B2

(12) United States Patent
Suzuki et al.

(10) Patent No.: US 7,967,951 B2
(45) Date of Patent: Jun. 28, 2011

(54) EMBOSSED CREPE PAPER AND ITS MANUFACTURING METHOD

(75) Inventors: Shinji Suzuki, Kochi (JP); Yukio Hayashi, Kochi (JP); Noriyasu Ike, Kochi (JP); Hiromu Matsumoto, Kochi (JP); Eri Tamura, Kochi (JP); Yasunori Endo, Kochi (JP); Jun Morisawa, Kochi (JP); Maya Sasaki, Kochi (JP); Kenji Taniguchi, Saiatama (JP)

(73) Assignee: Kawano Paper Co., Ltd., Kochi (JP)

( * ) Notice: Subject to any disclaimer, the term of this patent is extended or adjusted under 35 U.S.C. 154(b) by 0 days.

(21) Appl. No.: 12/853,607

(22) Filed: Aug. 10, 2010

(65) Prior Publication Data

US 2011/0020605 A1 Jan. 27, 2011

Related U.S. Application Data

(62) Division of application No. 11/447,119, filed on Jun. 6, 2006, now Pat. No. 7,799,167.

(30) Foreign Application Priority Data

Jun. 9, 2005 (JP) ..... 2005-169829

(51) Int. Cl.
*B31F 1/07* (2006.01)
*B31F 1/12* (2006.01)
*B31F 1/36* (2006.01)

(52) U.S. Cl. ..... 162/117; 162/111; 162/142; 162/204; 162/123; 428/153; 428/156; 428/340; 428/34.2; 428/172

(58) Field of Classification Search ..... 162/109, 162/111–113, 117, 158, 123, 204–207, 118, 162/141, 142; 264/282–284; 156/183, 209, 219; 428/152–153, 156, 172, 340, 34.1–34.2
See application file for complete search history.

(56) References Cited

U.S. PATENT DOCUMENTS 2,803,188 A 8/1957 Duvall
(Continued)

FOREIGN PATENT DOCUMENTS

DE 1105700 4/1961
(Continued)

OTHER PUBLICATIONS

Michael Kouris, "Dictionary of Paper", 1996, TAPPI Press, 5th edition, pp. 344-346.

*Primary Examiner* — José A Fortuna
(74) *Attorney, Agent, or Firm* — Roylance, Abrams, Berdo & Goodman, L.L.P.

(57) ABSTRACT

An object of the present invention is to provide an embossed crepe paper which can clearly be formed into fine embossed shapes, and is excellent in the fluffy feel and therefore excellent in such as absorbency for fats. As a means of achieving this object, the method for manufacturing an embossed crepe paper, according to the present invention, is a method for manufacturing an embossed crepe paper comprising a step of embossing a raw crepe paper, wherein: a raw paper having a basis weight of 6 to 28 g/m$^2$ is used as the raw crepe paper; and the embossing step includes the steps of: (a) supplying the raw crepe paper with water in an amount of 0.1 to 100 weight % based on the basis weight to thereby put the raw crepe paper in a wet condition; (b) embossing the wet-conditioned raw crepe paper; and (c) drying the embossed wet-conditioned raw crepe paper.

6 Claims, 4 Drawing Sheets

U.S. PATENT DOCUMENTS

| | | | | |
|---|---|---|---|---|
| 3,203,850 | A | 8/1965 | McCarty | |
| 3,337,388 | A | 8/1967 | Wosaba | |
| 3,414,459 | A | 12/1968 | Wells | |
| 3,806,406 | A | 4/1974 | Ely | |
| 3,817,827 | A | 6/1974 | Benz | |
| 4,073,230 | A | 2/1978 | Akerson | |
| 4,127,637 | A | 11/1978 | Pietreniak et al. | |
| 4,135,024 | A | 1/1979 | Callahan et al. | |
| 5,126,015 | A | 6/1992 | Pounder | |
| 5,622,584 | A | 4/1997 | Kroyer | |
| 5,935,384 | A * | 8/1999 | Taniguchi | 162/172 |
| 6,398,909 | B1 | 6/2002 | Klerelid | |
| 6,458,447 | B1 | 10/2002 | Cabell et al. | |
| 7,799,167 | B2 * | 9/2010 | Suzuki et al. | 162/117 |
| 2003/0026953 | A1 | 2/2003 | Muller | |
| 2003/0041989 | A1 | 3/2003 | Oriarian et al. | |
| 2004/0094004 | A1 | 5/2004 | Julius | |
| 2004/0121124 | A1 | 6/2004 | Basler et al. | |
| 2005/0103456 | A1 | 5/2005 | Hein et al. | |
| 2006/0037724 | A1 | 2/2006 | Akai et al. | |
| 2006/0042767 | A1 | 3/2006 | Bhat et al. | |
| 2006/0278357 | A1 | 12/2006 | Suzuki et al. | |
| 2009/0126885 | A1 | 5/2009 | Akai et al. | |
| 2010/0186913 | A1 * | 7/2010 | Super et al. | 162/111 |
| 2011/0020605 | A1 * | 1/2011 | Suzuki et al. | 428/154 |

FOREIGN PATENT DOCUMENTS

| | | | |
|---|---|---|---|
| EP | 1096069 | | 5/2001 |
| EP | 1331308 | | 7/2003 |
| EP | 1731296 | | 12/2006 |
| FR | 2177856 | | 11/1973 |
| GB | 1345728 | | 2/1974 |
| JP | 50-145809 | | 12/1975 |
| JP | 63-166417 | | 10/1988 |
| JP | 07-216786 | | 8/1995 |
| JP | 11-323787 | | 11/1999 |
| JP | 2002-511537 | | 4/2002 |
| JP | 2002-526690 | | 8/2002 |
| JP | 2003-514640 | | 4/2003 |
| JP | 2003-164385 | | 6/2003 |
| JP | 2003-199687 | | 7/2003 |
| JP | 2004-218151 | | 8/2004 |
| JP | 2006-45690 | | 2/2006 |
| JP | 2006-083509 | | 3/2006 |
| JP | 2007015379 | A * | 1/2007 |
| WO | 9720107 | | 6/1997 |
| WO | 9858612 | | 12/1998 |
| WO | 99/53140 | | 10/1999 |
| WO | 9960206 | | 11/1999 |
| WO | 00/20685 | | 4/2000 |
| WO | 01/38640 | | 5/2001 |
| WO | 02/26481 | | 4/2002 |

* cited by examiner

EMBOSSED CREPE PAPER AND ITS MANUFACTURING METHOD

This application is a divisional application of Ser. No. 11/447,119, filed Jun. 6, 2006, now U.S. Pat. No. 7,799,167.

BACKGROUND OF THE INVENTION

A. Technical Field

The present invention relates to an embossed crepe paper excellent in a fluffy feel and its manufacturing method. In detail, the present invention is designed for: a fluffy-feel-abundant crepe paper utilized for such as facial tissues by embossing a raw crepe paper; and a method for manufacturing such a crepe paper.

B. Background Art

Among other tissue products used for such as cosmetic uses, there are two- or three-ply ones made of thin crepe paper. Among others such as toilet paper products, there are those which are provided with properties such as bulkiness and softness by embossment of crepe papers.

Separately therefrom, as moisture-retaining tissue products, there are those which are obtained by supporting a moisture-retaining component such as glycerol on crepe-treated thin crepe papers. The moisture-retaining component absorbs moisture to thus put the crepe papers in an adequate moisture-retained condition, so that when being used those crepe papers feel moist and soft and have a pleasant texture and are easy to wipe such as dirt off.

In patent document 1 below, there is disclosed an art in which a chemical liquid containing such as a moisture-retaining agent, a softening agent, and an antioxidant is coated to a base paper to thereby enhance textures such as a moist feel and softness and provide a home-use tissue which prevents the skin from smarting or reddening even if being often brought into contact with the skin.

As to multiple-ply products (e.g. tissues such that two or more pieces of crepe paper are piled on each other, toilet paper such that one or more pieces of crepe paper is wound in a roll shape), it is requested that an air layer should be interposed between plies of the crepe paper so that they are abundant in a fluffy feel. Its reason is that this "fluffy feel" not only makes them feel pleasant such as when being used but also enhances use properties such as sweat absorption.

Thus, as to a crepe paper, there is carried out a method in which the bulkiness is produced by embossing a raw crepe paper. That is, an embossed crepe paper.

In patent document 2 below, there is proposed an art in which a crepe paper is provided with a high roll bulkiness and a high roll hardness by steaming the crepe paper and then embossing it.

In patent document 3 below, there is disclosed a paper tissue and its manufacturing technique, wherein the paper tissue comprises multiple ply (paper layer) and has a predetermined caliper (thickness) and a predetermined physiological surface smoothness parameter. As a specific example, there is disclosed a manufacturing example in which a paper tissue is obtained by coating an embossed three-ply tissue with a lotion. Therefrom it follows that both the embossment and the supporting of a moisture-retaining liquid are carried out.

[Patent Document 1] JP-A-2003-164385 (Kokai)

[Patent Document 2] JP-A-2002-511537 (Kohyo)

[Patent Document 3] JP-A-2003-514640 (Kohyo)

The embossment in prior conventional tissue products was applied to a dry-conditioned raw crepe paper of which the paper-making and crepe treatment had been finished.

In the dry-conditioned raw crepe paper, fibers fixed to each other by hydrogen bonding are difficult to move each other. If such a raw crepe paper is embossed, then fibers do not smoothly move each other, so fibers themselves are broken or the hydrogen bonding between fibers are destroyed. As a result, the obtained embossed crepe paper is inferior in strength or tends to generate a paper dust.

There is known a crepe paper having the bonding between fibers reinforced with such as a paper strength agent in order to solve such problems. Since it has many bonded sites between fibers, there are advantages in that: deformation can be endured, the embossment can be comparatively well carried out, and the apparent density can be decreased. However, there is a tendency such that textures expressed by such as softness and a fluffy feel are deteriorated, so the commercial value as a tissue product is inferior.

In the method as described in patent document 2 above where steaming is carried out before the embossment, fibers are swollen with steam to thus become easy to deform, so that the embossment is easy to carry out. However, when drying after the embossment, the fibers tend to return to their unembossed shapes. There is also a demerit such that if water taken in the inside of the swollen fibers vaporizes, then the fibers, in other words, the embossed shapes, shrink, so that the embossed paper becomes hard.

There is also proposed an art in which the embossment is applied to an undried high-wet-conditioned raw crepe paper in the paper-making step. However, if the embossed raw crepe paper is dried by such as Yankee drier treatment, then its surface becomes smooth, so that embossed shapes disappear. If non-contact drying treatment with such as hot air is carried out, then the drying is possible without damaging the embossed shapes. However, it takes a long time and a large energy cost to dry the just made high-wet-conditioned raw crepe paper in the non-contact, so the economical performance is inferior. It is impossible to smooth the surface or equalize such as thickness by the Yankee drier treatment. The surface quality of the paper is deteriorated, or great dispersions in thickness and properties are made. In the paper-making step, sufficient hydrogen bonding is not formed between fibers, but fibers are in a condition of being free to become deformed and move each other, so it is difficult to clearly form fine embossed shapes. In the drying step, the embossed shapes tend to crumble, become deformed, or revert.

If, as described in patent document 3 above, an embossed paper material is coated with a moisture-retaining liquid, then such an embossed paper material cannot uniformly be coated with the moisture-retaining liquid. The embossed patterns crumble due to absorption of the moisture-retaining liquid. The functions of the embossment and of the moisture-retaining liquid cannot sufficiently be exercised.

It can also be considered post-embossing a moisture-retaining tissue manufactured by carrying out moisture-retaining treatment with a moisture-retaining liquid. However, on the moisture-retaining tissue softened by the moisture-retaining treatment, it is difficult to form embossed shapes by only carrying out conventional embossment. In addition, since the moisture-retaining treatment deteriorates the paper strength, damage tends to be done in the embossing step, so the embossment is difficult.

SUMMARY OF THE INVENTION

A. Object of the Invention

Thus, an object of the present invention is to solve the aforementioned problems of the aforementioned prior arts for manufacturing of embossed crepe papers and thereby provide an embossed crepe paper which can clearly be formed into fine embossed shapes and is bulky and excellent in the softness and also has an enough strength and is further excellent in the absorbency for such as fats and extremely excellent in the fluffy feel.

B. Disclosure of the Invention

A method for manufacturing an embossed crepe paper, according to the present invention, is a method for manufacturing an embossed crepe paper comprising a step of embossing a raw crepe paper, wherein:

a raw paper having a basis weight of 6 to 28 g/m$^2$ is used as the raw crepe paper; and the embossing step includes the steps of:

(a) supplying the raw crepe paper with water in an amount of 0.1 to 100 weight % based on the basis weight to thereby put the raw crepe paper in a wet condition;

(b) embossing the wet-conditioned raw crepe paper; and (c) drying the embossed wet-conditioned raw crepe paper.

When the above method of the present invention is carried out, it is preferable that in the embossing step, two or more pieces of the raw crepe paper are individually separately embossed and then piled on each other. In addition, separately therefrom, it is preferable that in the embossing step, two or more pieces of the raw crepe paper are piled on each other and then embossed at the same time and then once separated into the embossed individual pieces of the raw crepe paper and then piled on each other again.

An embossed crepe paper excellent in a fluffy feel, according to the present invention, is an embossed crepe paper obtained by embossing a raw crepe paper, wherein the embossed crepe paper has a basis weight of 6 to 28 g/m$^2$ and embossed shapes of 0.01 to 3.00 mm in height difference and 4 to 200 in number/cm$^2$.

As to the embossed crepe paper according to the present invention, at the specific mention of its preferable feature in the form of a product, this embossed crepe paper is a multiple-ply product needing a fluffy feel and, for example, can be a tissue such that two or more pieces of raw crepe paper are piled on each other and also can be toilet paper such that one or more pieces of raw crepe paper is wound in a roll shape.

Subject-matter of the present invention is hereinafter described in detail.

[Raw Crepe Paper]:

Raw crepe papers which are utilized for conventional manufacturing of embossed crepe papers are usable.

The raw crepe papers are products by forming fine wrinkles, that is, crepes when paper materials made into papers are dried by such as Yankee drier treatment.

As materials for the raw crepe papers, there can be used the same materials as those for conventional crepe papers. Common raw pulp fiber materials are usable. Besides wood fibers of hardwoods and softwoods, it is also possible to use combinations such as with plant fibers other than wood and with synthetic fibers.

Also to paper-making of raw crepe papers and to treatment apparatuses and conditions for such as crepe processing, there can be applied techniques common to conventional crepe papers.

Favorably in points of such as water-retaining ability, water absorbency, strength, paper-making ability, and costs, the raw crepe paper includes wood pulp as not less than 70 weight % of raw fiber materials for the raw crepe paper. The wood pulp is favorably at lease one member selected from the group consisting of hardwood pulp and softwood pulp. The wood pulp favorably has a Canadian standard freeness of not less than 300 ml, more favorably 500 to 700 ml, as prescribed in JIS-P8121. As to the wood pulp, if beating proceeds too much, there occurs a problem such that bonding between fibers becomes too strong, so that the wood pulp becomes hard. Therefore, it is important to control the aforementioned freeness. Used as the raw crepe paper is raw crepe paper having a basis weight of 6 to 28 g/m$^2$. If the basis weight is too small, it is difficult to uniformly disperse fibers, and also the strength is weak. If the basis weight is too large, the strength is too strong, and the paper is hard. The raw crepe paper favorably has a crepe ratio of 3 to 50%, more favorably 6 to 30%. If the crepe ratio is too small, it is difficult to uniformly form crepes. If the crepe ratio is too large, shapes of crepes are coarse.

As to the raw crepe paper, only one piece can be used to manufacture an embossed crepe paper, or two or more pieces are piled on each other to manufacture a multiple-ply embossed crepe paper. The number of pieces being piled on each other can be set in the range of 2 to 6, preferably 2 to 3.

In the embossing step, process steps such as supplying of water, embossing, and drying can be carried out in a state where a predetermined number of pieces of raw crepe paper are piled on each other. In addition, it is also possible that: a part or all of the process steps are applied to one-ply raw crepe papers, and thereafter they are piled on each other or, after this piling, folded or wound.

[Supply of Water]:

Water is supplied to a raw crepe paper in a liquid condition. The water infiltrates the spaces between fibers constituting the raw crepe paper to thus come to exist in the form of free water, and thus functions to loosen hydrogen bonding between the fibers. However, unlike steam, it is difficult for water to infiltrate the inside of the fibers, and therefore, the swelling of fibers due to the absorption of water does not occur so much.

As for the supply of water, an amount of 0.1 to 100 weight % based on the basis weight is supplied to a substantially dry-conditioned raw crepe paper to thereby put it in a wet condition. The raw crepe paper, to which water has been supplied, comes in a wet condition where excessive water is included in an amount of 0.1 to 100 weight % based on the basis weight. Hereupon, the excessive water means water which exists between fibers of the raw crepe paper.

The supply of water can be set, preferably, in the range of 0.5 weight % to 50 weight % based on the basis weight. More preferably, water of 1 weight % to 20 weight % is supplied. In the case where the amount of supplied water is too low, such as a targeted increase in the easiness of embossing cannot be achieved. In the case where the amount of supplied water is too high, hydrogen bonding between fibers are released too much and thus properties such as strength deteriorate. In addition, the processibility is reduced such that the raw paper is wrinkled, and further the drying load is increased.

As for the means for supplying water, various types of means for supplying water, which are adopted in conventional paper manufacturing technologies, processing technologies and the like, can be adopted as long as a necessary amount of liquid-conditioned water can be quickly supplied. For example, a method in which water is showered from a nozzle to spray water droplets to a raw crepe paper can be adopted. A method for pressing a roller, which has been wetted with water or has absorbed water, against a raw crepe paper can also be adopted. Water can be applied by printing to a raw crepe paper using a printing roll such as a gravure printing roll.

Though the temperature of water is not particularly limited, it may be close to ordinary temperature. In the case where the temperature is too high, excessive water easily infiltrates the inside of the fibers. Usually, the temperature can be set in the range of 5° C. to 40° C.

Water can be supplied together with an assistant agent (chemical liquid component) for treating a raw crepe paper in some manner. Concretely speaking, the assistant agent and water can be supplied simultaneously if an aqueous solution or dispersion that contains the assistant agent (e.g. a moisture-retaining liquid which contains a moisture-retaining component) is supplied to the raw crepe paper. The amount of water that is included in the aqueous solution or dispersion corresponds to the amount of supplied water. As for such an assistant agent (chemical liquid component), there can be cited such as the below-mentioned moisture-retaining component, softening component and adhesive component and besides, an ink component.

[Embossing]:

A wet-conditioned raw crepe paper is embossed. Predetermined embossed shapes are provided to the raw crepe paper.

It is necessary for the raw crepe paper to be in an appropriate wet condition in the stage of embossing after water has been supplied as described above. The object cannot be achieved in the case where a long time has passed from the supplying of water till embossing, during which the water content becomes too low as a result of the evaporation of the water that has been supplied to the raw crepe paper.

Accordingly, it can also be said that the above described amount of supplied water is a water content condition for the raw crepe paper just before being embossed. However, the moisture in the raw crepe paper being in a state of equilibrium with the environmental moisture by its absorption before the supply of water, or the moisture in the raw crepe paper being on the way of moisture absorption and therefore unequilibrated before the supply of water, is not included in the water content resulting from the supplying of water.

As for the processing apparatus, the processing method, the processing conditions and the like for the embossment, conventional manufacturing technologies for embossed papers can be used. Micro-embossing technologies for forming particularly fine embossed shapes are preferably applied among other embossing technologies.

A method in which an embossing roll having a hard surface where fine embossed shapes are made is pressed against a raw crepe paper can be adopted as a general embossing technology. The hard surface can be made of a metal material such as steel, a ceramic material, a hard synthetic resin material or the like. A material on the surface of which a variety of coating processings have been carried out can also be used. A roll having a surface that can elastically be changed in shape can be used as a supporting roll which is placed so as to face the embossing roll in such a manner that the raw crepe paper is pinched between the embossing roll and the supporting roll. The surface of the supporting roll elastically changes in shape so as to be embossed in accordance with the embossed shapes of the embossing roll. A roll having a flat surface made of the same hard material as that of the embossing roll can be used as the supporting roll. The gap between the embossing roll and the supporting roll can be changed, and thereby, a partial difference in the thickness and in the density can be easily caused in the raw crepe paper. Embossing can also be carried out by pinching a raw crepe paper between a pair of embossing rolls, both of which have embossed shapes on the surface. In this case, embossed shapes are created on both surfaces of the raw crepe paper.

The arrangement patterns and the dimensions of the embossed shapes which are formed by embossing can be set in the same manner as for conventional embossed crepe papers. Some embossed shapes have a main object of providing a crepe paper with property functions such as bulkiness, softness and water absorbency, and other embossed shapes have a main object of providing a crepe paper with design functions by expressing such as patterns, letters and symbols, and still other embossed shapes have an object of providing functions (e.g. reinforcement or folding) to portions such as side end portions of a crepe paper. Also, other embossed shapes have a number of objects. Basically, an embossed shape for providing predetermined property functions is provided to the entirety of the crepe paper, and another embossed shape having an object of providing other functions can be partly added.

As for the concrete dimensional conditions of the embossed shape, embossments of 0.01 to 3.00 mm in height difference and 4 to 200 in number/cm$^2$ can be made. Preferably, the embossed shapes are set in the range of 0.01 to 1.00 mm in height difference and in the range of 10 to 200 in number/cm$^2$, and more preferably in the range of 0.05 to 0.50 mm in height difference and in the range of 20 to 100 in number/cm$^2$.

As to wet products (e.g. cleaning articles) that are not dry products or moisture-retaining type products for which the embossed crepe paper of the present invention is mainly designed, it is requested from demand in their uses that extremely large embossed shapes exceeding 1.00 mm in height difference should be provided. However, in some cases, such embossed shapes are unnecessarily too high from the viewpoint of uses of the crepe paper of the present invention. In addition, if the embossed shapes exceeding 1.00 mm in height difference are applied to a thin crepe paper, then there are cases where the raw crepe paper tears or a hole opens therein or the strength becomes too weak, because the embossed shapes are too high. Therefore, the height difference is preferably not more than 1.00 mm.

As to the embossed crepe paper of the present invention, a thin raw crepe paper having a low basis weight is used in view of its uses, and therefore, even if the height difference in the embossed shapes is 1.00 mm (preferably 0.50 mm) at the maximum, then, when a load of 0.3 kPa is applied to this embossed crepe paper of the present invention in a condition impregnated with an aqueous chemical, its thickness does not reach 1.0 mm.

Usually, embossing can be carried out in an ordinary temperature environment without carrying out particular heating or cooling. In addition, if the below-described heat embossing is adopted, the embossing and the subsequent quick drying can be achieved at the same time.

Furthermore, if a wet embossing roll is used, the supply of water or water containing the assistant agent (hereinafter these are referred to as "aqueous species") and the embossing can be carried out at the same time. Specifically, for example, an aqueous species is sprayed to the surface of an embossing roll, or a roll which supplies an aqueous species is brought into contact with the embossing roll to thereby transfer the aqueous species to the surface of the embossing roll. In addition, it is also possible to put the embossing roll in a wet condition by passing the embossing roll through the inside of a vat containing an aqueous species. The supply of the aqueous species and the embossing can be carried out at the same time by embossing the raw crepe paper with these wet embossing rolls.

[Drying]:

It is desirable that the embossed wet-conditioned raw crepe paper is quickly dried.

The water that has been supplied to the raw crepe paper before embossing exists as the aforementioned excessive water between fibers constituting the raw crepe paper. This excessive water evaporates by drying after embossing, so that new hydrogen bonding is created between the fibers while the embossed shapes that have been formed by embossing is maintained. As a result, an embossed crepe paper, of which the embossed shapes are well-maintained, can be gained.

If the embossment is in the wet condition after embossing, then, when the paper is, for example, being run in a processor, wound, or stored, the paper tends to become deformed, so the embossed shapes crumble or becomes unclear. In some cases, the hydrogen bonding between the fibers is released, so that the deterioration of properties such as strength occurs.

In the case where the paper is embossed on a processor, if the paper is quickly dried without being left for a long time, then an embossed crepe paper, of which the embossed shapes are well maintained, can be gained.

Accordingly, the quick drying means to complete the drying in a short period of time to such a degree that the above described problems do not occur. Hereupon, "quick(ly)" specifically means ending the drying within 300 seconds, preferably within 60 seconds, from just after the embossing. This "ending the drying", for example, means when the raw crepe paper 10 goes out of a drying means such as the drying portion 50 of FIG. 1 mentioned below or the heat embossing roll 48 of FIG. 3 mentioned below.

The raw crepe paper that has finished being dried comes in a dry condition where the water content is 3% to 8%, preferably 4% to 7%. Also in the case where the raw crepe paper includes a moisture-retaining component or is supplied with a moisture-retaining liquid before being embossed, the paper can be dried so that the above described water content conditions will be satisfied. The conditions for drying may be set so that the water content, in the stage where embossing and drying have been completed, will be lowered by not less than 2% as compared with the water content before embossing.

As for the drying apparatus, drying method, treatment conditions and the like, drying technologies in conventional paper manufacturing technologies can be adopted. However, non-contact drying technologies are adopted in order not to destroy the embossed shapes.

As for the concrete drying method, drying by passing a heated atmosphere through, blowing with hot wind, irradiation with infrared rays or far-infrared rays, and irradiation with electromagnetic waves or ultrasonic waves can be adopted.

As for the drying conditions, the raw crepe paper can be heated at a temperature of 40° C. to 200° C. and thereby dried up within 300 seconds. Preferably, the raw crepe paper is heated at a temperature of 60° C. to 80° C. and thereby dried up within 60 seconds. More preferably, the raw crepe paper is heated at a temperature of 60° C. to 80° C. and thereby dried up within 30 seconds.

[Recovery of Embossed Crepe Paper]:

An embossed crepe paper gained by finishing its drying has embossed shapes.

In the case where a one-ply raw crepe paper is embossed, the embossed crepe paper may be recovered by winding it around a roll or the like as it is after drying. The paper can be stored, transported and conveyed to the next step (e.g. a piling step) in the rolled state. Another processing for cutting or folding the embossed crepe paper can also be carried out subsequently.

If two or more pieces of one-ply embossed crepe paper are piled on each other and processed into such as two-ply or three-ply tissue or toilet paper, then products more excellent in the fluffy feel and the softness are obtained.

In the case where a multiple-ply raw crepe paper is embossed, it is possible that: the embossed crepe paper is separated into every one-ply embossed raw crepe paper after drying, and after that, they are again piled on each other and recovered on a roll or the like.

This separation and re-piling can more increase the bulkiness and softness of the embossed crepe paper. Even in the case where a one-ply raw crepe paper is embossed, the piling of pieces of the obtained one-ply embossed raw crepe paper can more increase the bulkiness and softness of the embossed crepe paper.

In the case where a treatment of supplying a liquid component or water, such as a moisture retention treatment, is not applied to the manufactured embossed crepe paper, rather there is less crumbling of the embossed shapes or less deterioration in the properties such as strength.

[Impregnation of Assistant Agent]:

At least one of moisture-retaining components and softening components can be impregnated as an assistant agent into a raw crepe paper before its embossing. In this case, the raw crepe paper becomes an assistant-agent-containing raw crepe paper.

These components may be used individually alone. However, if they are jointly used, it becomes possible to adequately control properties and texture of the crepe paper.

In order to enhance the bulkiness and softness of paper and the paper strength, hitherto there have been carried out arts in which: assistant agents such as bulkiness-enhancing agents, softening agents, and paper strength agents are mixed into a pulp slurry to make pulp adsorb them, and then the mixture is made into paper. These arts are called intra-addition methods. However, in the intra-addition methods, it is difficult to make the pulp adsorb the assistant agents sufficiently. Therefore, there have been cases where: unadsorbed assistant agents remain in a white water circulating system of a paper-making machine and, for example, agglomerate like pitch to thus cause stains on paper, or adhere to a drier to thus cause unsatisfactory paper release, so that they exercise a bad influence on the paper-making process.

On the other hand, if the addition of the assistant agents is carried out as post-processing to paper after the paper making, then it is possible to sufficiently intend the bulkiness enhancement, the softening, and the strength enhancement. As a result, the above-mentioned bad influence by the intra-addition method is not produced, and besides, the ratio of the assistant agents which effectively work is also high. Furthermore, even under conditions where the assistant agents exist in a small amount of wetting water, in the present invention the performance of the embossment makes it possible to sufficiently spread the assistant agents between fibers and to thus sufficiently exercise the above-mentioned effects.

As impregnating techniques, basically such as conventional manufacturing techniques for moisture-retaining papers can be applied.

The assistant agent can be used in the form of an aqueous solution, emulsion or dispersion having water as a solvent, or can be used in the form of a non-aqueous solution using an organic solvent or the like.

In the case where the assistant agent liquid includes water as a solvent, a part or all of the water for putting a raw crepe paper in a wet condition can be supplied as water that is included in the assistant agent liquid.

If the amount of water that is included in the assistant agent liquid is sufficient for a raw crepe paper to have a predetermined water content, then the step of supplying the assistant agent liquid can serve as the step of supplying water, too.

If the amount of water that is included in the assistant agent liquid is less than the sufficient amount for putting a raw crepe paper in a predetermined wet condition, then the step of supplying water to the raw crepe paper can be carried out after the step of supplying the assistant agent liquid to the raw crepe paper has been carried out. In this case, in the step of supplying water, water can be supplied in an amount given by subtracting the amount of water that has been supplied by the assistant agent liquid.

As for the apparatus and the method for supplying an assistant agent liquid, technologies common to the above described technologies for supplying water can be applied.

<Moisture-Retaining Component>:

The moisture-retaining component gives the embossed crepe paper a moist feel. However, even if conventional embossment is applied to crepe paper containing the moisture-retaining component, the paper is so soft that embossed patterns easily disappear with the passage of time. Only by the present invention method in which water is supplied before the embossment, it becomes possible to clearly provide such a soft crepe paper with embossed shapes.

As an assistant agent liquid containing the moisture-retaining component, that is, as a moisture-retaining liquid, there can be used those which contain moisture-retaining components utilized for such as conventional moisture-retaining tissues. As the moisture-retaining components, there can be cited such as glycerol, diglycerol, polyglycerol, ethylene glycol, diethylene glycol, polyethylene glycol, propylene glycol, 1,3-butylene glycol, sorbitol, xylitol, erythritol, mannitol, lactitol, oligosaccharide alcohol, maltitol, reducing starch hydrolysate, fruit sugar (D-fructose), grape sugar (D-glucose), oligosaccharide, trehalose, glycine betaine, pyrrolidonecarboxylic acid and its salts, hyaluronic acid and its salts, lactic acid and its salts, and urea.

The amount of the moisture-retaining component being impregnated is preferably in the range of 1 to 100%, more preferably 5 to 30%, based on pulp. If this amount is smaller than 1%, it is difficult that the moisture-retaining component takes effect. If the above amount is larger than 100%, the strength of the crepe paper is deteriorated, and also, because the impregnation amount is too large, it is difficult to form embossments.

In the case where water taken from the environment by the moisture-retaining component exists in a raw crepe paper to which a moisture-retaining liquid has been supplied, then this water exists as free water between fibers constituting the raw crepe paper. Therefore, if the paper is dried after embossing, then the object of the present invention can be achieved in the same manner as in the above described case where water is supplied. Incidentally, moisture that has been taken into the moisture-retaining component is in a state of being difficult to evaporate. Therefore, it is desirable to set the drying conditions in such a manner that the paper can be dried in a short period of time at a relatively high temperature. For example, it is preferable for the temperature for drying to be set at not lower than 50° C., more preferably not lower than 60° C., within the range of the above described drying conditions. It is preferable for the time for drying to be within 30 seconds, more preferably within 10 seconds.

<Softening Component>:

The softening component includes a lipophilic substance or a component having a lipophilic group. If the softening component coexists in wetting water of the raw crepe paper, then the hydrogen bonding between pulp fibers can be restricted from becoming too strong as the wetting water dries, so that a soft crepe paper can be obtained. In addition, the softening component contained in the raw crepe paper reduces the hydrophilicity of the pulp surface of the raw crepe paper, and therefore, when the wetting water evaporates, the distance between pulp fibers becomes little shortened, so that the bulkiness of the raw crepe paper is enhanced. Thus, a fluffy and soft crepe paper can be obtained.

The softening component is preferably supplied in a state emulsified, dispersed or dissolved in water. Therefore, as the occasion demands, an emulsifier, a dispersant, or a solubilizing agent is used.

As the softening component, there can be cited such as hydrocarbons, oils and fats, ester oils, fatty acids, higher alcohols, silicones, waxes, and surfactants.

Specifically, there are the following: as the hydrocarbons, such as liquid paraffin and squalane; as the oils and fats, such as olive oil, tsubaki oil, castor oil, soybean oil, coconut oil, beef fat, tri(caprylic acid-capric acid)glycerol, and tri(caprylic acid)glycerol; as the ester oils, such as isopropyl myristate, isopropyl palmitate, and cetyl octanoate; as the fatty acids, such as fatty acids, fatty acid salts, and glycerol fatty acid esters; as the fatty acids, such as stearic acid, palmitic acid, myristic acid, lauric acid, capric acid, and caprylic acid; as the fatty acid salts, salts of such as sodium, potassium, triethanolamine, diethanolamine, and monoethanolamine of the above various fatty acids; as the glycerol fatty acid esters, such as glycerol monofatty acid esters and polyglycerol fatty acid esters of the above various fatty acids; as the higher alcohols, such as lauryl alcohol, myristyl alcohol, cetanol, stearyl alcohol, octyldodecanol, and behenyl alcohol; as the silicones, such as amino-modified, epoxy-modified, carboxyl-modified, polyether-modified, and polyglycerol-modified silicone oils, and dimethylpolysiloxane; as the waxes, such as beeswax, carnauba wax, and lanolin. As the surfactants, there are used anionic, cationic, amphoteric, and nonionic surfactants. In the cases of the nonionic surfactants, their HLB values are preferably not more than 12.

The amount of the softening component being impregnated is preferably in the range of 0.01 to 30%, more preferably 0.1 to 10%, based on pulp. If this amount is smaller than 0.01%, it is difficult that the softening component takes effect. If the above amount is larger than 30%, a damp and sticky feel and an oily feel are too strong, so that the texture is deteriorated.

<Adhesive Component>:

The adhesive component can be added together with the assistant agent. The adhesive component can reinforce the hydrogen bonding between pulp fibers. Therefore, by the impregnation of the adhesive component, the following effects can be expected. That is, if the moisture-retaining component or the softening component is increased in order to emphasize a moist feel, or softness and a fluffy feel, then there is an unfavorable possibility that it may become impossible to keep the embossed shapes or necessary strength of the crepe paper. However, in such a case, if the adhesive component is added, then the hydrogen bonding strength between pulp fibers is increased, so that it becomes possible to realize a necessary sufficient strength at the same as while keeping high the moist feel, the softness, and the bulkiness (and the fluffy feel) by the retention of the embossed shapes.

As the adhesive component, there can be cited such as starches, cellulose derivatives, seaweeds, synthetic pastes, and polyacrylamide resins. Specifically, there are the following: as the starches, such as flour starch, corn starch, and tapioca starch; as the cellulose derivatives, such as carboxymethyl cellulose sodium (CMC-Na), methyl cellulose (MC), and ethyl cellulose (EC); as the seaweeds, such as sodium alginate; as the synthetic pastes, such as polyvinyl alcohol and vinyl acetate.

The amount of the adhesive component being impregnated is in the range of 0.01 to smaller than 1.0%, preferably 0.8% at the maximum, more preferably 0.5% at the maximum, based on the weight of the embossed crepe paper. If this amount is smaller than 0.01%, it is difficult that the adhesive component takes effect. However, if the above amount is so excessively large as not to be smaller than 1.0%, then the "fluffy feel" aimed at in the present invention is damaged.

That is, as to the aforementioned wet products (e.g. cleaning articles), bulkiness more than intended in the present invention is needed from demand in their uses. Thus, there may be considered a method like the present invention in which when a raw paper is embossed, it is supplied with water and then embossed to thereby be provided with sufficient bulkiness. However, in the stage of a product, the base material provided with the bulkiness in this way needs to be impregnated with water or a chemical liquid in a large amount reaching several times its weight. Therefore, its bulkiness is easily crumbled by a load during the use such as when an object is rubbed with this product. Thus, in order to prevent this crumbling of the bulkiness, it is needed to impregnate a binder in a large amount as much as not smaller than 1 weight %. However, as a result, the strength of the product becomes too high, so that the product becomes hard, inferior in the texture, and difficult to utilize for such as facial tissues. Above all, the "fluffy feel" intended in the present invention is lost.

In the embossed crepe paper of the present invention, according to its uses, there is a case where no adhesive component is contained.

[Heat Embossing Roll]:

If a heat embossing roll is used for embossing, then embossing and quick drying can both be carried out to a wet-conditioned raw crepe paper substantially simultaneously.

As the heat embossing roll, a roll having a material and a structure common to those of the above described conventional embossing rolls, except for that the surface of the heat embossing roll can be heated, can be used. As the means for heating the embossing roll, a material having excellent heat conductivity is used, and a heating mechanism such as an electrical heater can be built in. A path or a space for a heat medium, such as steam or hot water, to pass through may be provided in the embossing roll in such a manner that the heat medium that has been heated outside can be supplied.

The surface temperature of the heat embossing roll can be set in the range of 40° C. to 200° C. Preferably, the temperature is in the range of 60° C. to 120° C.

[Embossed Crepe Paper]:

The embossed crepe paper of the present invention is a product by embossing a raw crepe paper and can be manufactured, for example, by the above described manufacturing method of the present invention.

Particularly, when the raw crepe paper is used in a multiple-ply (e.g. two- or three-ply) form, the embossed crepe paper is more excellent in functions such as bulkiness, strength, and liquid absorbency.

The embossed crepe paper has a basis weight of 6 to 28 g/m$^2$. If the basis weight is too small, it is difficult to uniformly disperse fibers, and also the strength is weak. If the basis weight is too large, the strength is too strong, and the paper is hard.

As to the embossed shapes, the embossed crepe paper has embossed shapes of 0.01 to 3.00 mm in height difference and 4 to 200 in number/cm$^2$, preferably 0.01 to 1.00 mm in height difference and 10 to 200 in number/cm$^2$, and more preferably 0.05 to 0.50 mm in height difference and 20 to 100 in number/cm$^2$. That these embossed shapes are appropriate leads also to the enhancements of the apparent density and the oil absorbency. As for the plane shapes of the embossments, there are shapes such as curved shapes, including circles, long circles and ellipses, linear shapes constituting rectangles and other polygons, and shapes where curves and straight lines are combined.

The embossed crepe paper preferably has a longitudinal tensile strength of 0.15 to 1.5 km, more preferably 0.3 to 1.0 km, in terms of breaking length determined by the formula prescribed in the detailed description of examples of some preferred embodiments herein. If the paper is weaker than 0.15 km, then when used as a tissue or as toilet paper, the paper easily tears and is therefore unusable. If the paper is stronger than 1.5 km, then when used, the paper feels hard to the touch, so that the fluffy feel is damaged.

The embossed crepe paper preferably has an apparent density (under load) of not more than 0.09 g/cm$^3$ when measured in a two-ply state. In addition, the embossed crepe paper preferably has a smaller apparent density (under load) when measured in a two-ply state than when measured in a two-ply state of its unembossed raw crepe paper (which does not contain the assistant agent such as moisture-retaining component) by at least 20%. The apparent density prescribed hereupon is a value that is measured by a testing method that is prescribed in the detailed description of examples of some preferred embodiments herein, and means an apparent density under load conditions which are calculated from the thickness that is measured under a load of 10 gf/cm$^2$. Each of the property values described below is also a value which is given by the testing method that is prescribed in the detailed description of examples of some preferred embodiments herein. It is shown that the higher the ratio of reduction in the apparent density relative to the raw crepe paper is, the more effectively the enhancement of the bulkiness by the embossment is working.

It is preferable for the embossed crepe paper to be excellent in the oil (fat)-removing and absorbing function which is required when used as a tissue or paper towel. Concretely, it is desirable that the embossed crepe paper exhibits a larger oil-retaining amount when measured in a two-ply state than when measured in a two-ply state of its unembossed raw crepe paper (which does not contain the assistant agent such as moisture-retaining component) by at least 20%. Similarly, it is desirable that the embossed crepe paper exhibits a shorter oil-absorbing rate when measured in a two-ply state than when measured in a two-ply state of its unembossed raw crepe paper (which does not contain the assistant agent such as moisture-retaining component) by at least 30%.

It is preferable for the embossed crepe paper to have a softness of not more than 70 mN/100 mm when measured in a two-ply state. The method for testing the softness is also prescribed in the below-mentioned detailed description of examples of some preferred embodiments herein.

[Assistant-Agent-Impregnated Embossed Crepe Paper]:

As to the embossed crepe paper according to the present invention, among assistant-agent-impregnated embossed crepe papers obtained by impregnating at least one of moisture-retaining components and softening components, a moisture-retaining-component-containing embossed crepe paper which contains the moisture-retaining component comes particularly in a water-containing condition by absorbing and retaining the environmental moisture in the environment of storage, distribution and use even if it is in a dry condition at the time of manufacture. The embossed crepe paper gives a moist feel to the skin and exhibits an excellent wiping function by having an appropriate water content.

Also as for the property conditions of the moisture-retaining-component-containing embossed crepe paper, basically it is desirable for the aforementioned conditions generally prescribed for the above described embossed crepe paper to be satisfied.

In the case of the moisture-retaining-component-containing embossed crepe paper, particularly, a moisture-retaining-component-containing embossed crepe paper of which the aforementioned apparent density (under load) when measured in a two-ply state is smaller than that when measured in a two-ply state of a moisture-retaining-component-containing raw crepe paper (which is unembossed and contains the moisture-retaining component) by at least 10% is preferable because such has an excellent feel to the skin, including softness and fluffiness. A moisture-retaining-component-containing embossed crepe paper which exhibits a larger oil-retaining amount when measured in a two-ply state than when measured in a two-ply state of a moisture-retaining-component-containing raw crepe paper (which is unembossed and contains the moisture-retaining component) by at least 30% is preferable because such has an excellent oil (fat)-removing and absorbing function. Furthermore, as to the oil-absorbing rate (s) when measured in a two-ply state, a moisture-retaining-component-containing embossed crepe paper which exhibits a short oil-absorbing rate (s) of not greater than 50% of that when measured in a two-ply state of the aforementioned moisture-retaining-component-containing raw crepe paper being unembossed and containing the moisture-retaining component is preferable.

A moisture-retaining-component-containing embossed crepe paper in which two pieces of raw crepe paper are piled on each other, preferably, has an apparent density (under load) of not more than 0.13 g/cm$^3$, a softness of not more than 40 mN/100 mm, and a longitudinal tensile strength of 0.15 to 1.5 km in terms of breaking length determined by the formula prescribed in the detailed description of examples of some preferred embodiments herein. A moisture-retaining-component-containing embossed crepe paper in which three pieces of raw crepe paper are piled on each other, preferably, has an apparent density (under load) of not more than 0.11 g/cm$^3$ and a softness of not more than 60 mN/100 mm.

Also as for the property conditions of the softening-component-containing embossed crepe paper which contains the softening component among the assistant-agent-impregnated embossed crepe papers mentioned above, basically it is desirable for the aforementioned conditions generally prescribed for the above described embossed crepe paper to be satisfied.

In the case of the softening-component-containing embossed crepe paper, particularly, a softening-component-containing embossed crepe paper of which the aforementioned apparent density (under load) when measured in a two-ply state is smaller than that when measured in a two-ply state of a softening-component-containing raw crepe paper (which is unembossed and contains the softening component) by at least 15% is preferable because such has an excellent feel to the skin, including softness and fluffiness. A softening-component-containing embossed crepe paper which exhibits a larger oil-retaining amount when measured in a two-ply state than when measured in a two-ply state of a softening-component-containing raw crepe paper (which is unembossed and contains the softening component) by at least 15% is preferable because such has an excellent oil (fat)-removing and absorbing function. Furthermore, as to the oil-absorbing rate (s) when measured in a two-ply state, a softening-component-containing embossed crepe paper which exhibits a short oil-absorbing rate (s) of not greater than 20% of that when measured in a two-ply state of the aforementioned softening-component-containing raw crepe paper being unembossed and containing the softening component is preferable.

A softening-component-containing embossed crepe paper in which two pieces of raw crepe paper are piled on each other, preferably, has an apparent density (under load) of not more than 0.11 g/cm$^3$, a softness of not more than 70 mN/100 mm, and a longitudinal tensile strength of 0.15 to 1.5 km in terms of breaking length determined by the formula prescribed in the detailed description of examples of some preferred embodiments herein.

In addition, as to the embossed crepe paper according to the present invention, if the softening component (and the adhesive component, according to circumstances) is also impregnated separately from the moisture-retaining component or jointly therewith, then the quality of the paper, particularly, its strength or texture, can be adequately controlled and brought into accordance with various uses.

[Properties of Embossed Crepe Paper of Present Invention]:

As the embossed crepe paper of the present invention, for example, embossed crepe papers having the following properties are preferable.

An embossed crepe paper wherein: the raw crepe paper includes hardwood pulp and/or softwood pulp (these pulps desirably has a Canadian standard freeness of not less than 300 ml) as not less than 70 weight % of raw fiber materials for the raw crepe paper and has a basis weight of 6 to 28 g/m$^2$ and a crepe ratio of 3 to 50%; and the embossed crepe paper has an apparent density (under load) of not more than 0.09 g/cm$^3$, a softness of not more than 70 mN/100 mm and a longitudinal tensile strength of 0.15 to 1.5 km in terms of breaking length determined by the formula prescribed in the detailed description of examples of some preferred embodiments herein, when measured in a two-ply state.

An embossed crepe paper which has a smaller apparent density (under load) when measured in a two-ply state than when measured in a two-ply state of its unembossed raw crepe paper by at least 20%.

An embossed crepe paper which exhibits a larger oil-retaining amount when measured in a two-ply state than when measured in a two-ply state of its unembossed raw crepe paper by at least 20%.

An embossed crepe paper which contains a moisture-retaining component and has an apparent density (under load) of not more than 0.13 g/cm$^3$, a softness of not more than 40 mN/100 mm and a longitudinal tensile strength of 0.15 to 1.5 km in terms of breaking length determined by the formula prescribed in the detailed description of examples of some preferred embodiments herein, when measured in a two-ply state.

An embossed crepe paper which contains a moisture-retaining component and has a number of pieces being piled on each other of 3, an apparent density (under load) of not more than 0.11 g/cm$^3$ and a softness of not more than 60 mN/100 mm. An embossed crepe paper which contains a moisture-retaining component and has a smaller apparent density (under load) when measured in a two-ply state than when measured in a two-ply state of its unembossed raw crepe paper by at least 10% wherein the unembossed raw crepe paper contains the moisture-retaining component.

An embossed crepe paper which contains a moisture-retaining component and exhibits a larger oil-retaining amount when measured in a two-ply state than when measured in a two-ply state of its unembossed raw crepe paper by at least 30% wherein the unembossed raw crepe paper contains the moisture-retaining component.

An embossed crepe paper which contains a softening component and has an apparent density (under load) of not more than 0.11 g/cm$^3$, a softness of not more than 70 mN/100 mm and a longitudinal tensile strength of 0.15 to 1.5 km in terms of breaking length determined by the formula prescribed in the detailed description of examples of some preferred embodiments herein, when measured in a two-ply state.

An embossed crepe paper which contains a softening component and has a smaller apparent density (under load) when measured in a two-ply state than when measured in a two-ply state of its unembossed raw crepe paper by at least 15% wherein the unembossed raw crepe paper contains the softening component.

An embossed crepe paper which contains a softening component and exhibits a larger oil-retaining amount when measured in a two-ply state than when measured in a two-ply state of its unembossed raw crepe paper by at least 15% wherein the unembossed raw crepe paper contains the softening component.

[Uses of Embossed Crepe Paper]:

This embossed crepe paper excellent in a fluffy feel, according to the present invention, can be utilized for a variety of uses where bulkiness, softness, and absorbing and wiping performances for oil and the like are required. It can be utilized for uses where an embossed crepe paper has so far been used. In particular, the moisture-retaining-component-containing embossed crepe paper can be utilized for uses where a moisture-retaining paper, such as moisture-retaining tissue, has so far been used.

For example, facial tissues can be cited. Paper towels, toilet paper and kitchen paper can also be cited. The embossed crepe paper according to the present invention is suitably used particularly for such as moisture-retaining tissues and moisture-retaining toilet paper.

C. Effects of the Invention

In the method for manufacturing an embossed crepe paper according to the present invention, a raw crepe paper is supplied with water to thereby put the raw crepe paper in an adequate wet condition and then embossed and thereafter dried.

The raw crepe paper being in the adequate wet condition can be well embossed, so that even the fine embossed shapes can clearly be formed. Such as damage to fibers constituting the raw crepe paper and destruction of hydrogen bonding between fibers are done little, and thus, the properties of the raw crepe paper are spoiled little. If the wet-conditioned raw crepe paper having finished being embossed is dried, then the formed embossed shapes are fixed without crumbling or deforming themselves, so that an embossed crepe paper having clear embossed shapes can be gained. The strength is also little deteriorated by the embossment.

The gained embossed crepe paper has fine and clear embossed shapes and is small in density and excellent in properties such as bulkiness and softness. Above all, when the raw paper is used in a multiple-ply (e.g. two- or three-ply) form, the embossed crepe paper is more excellent in the "fluffy feel" and is more excellent in the oil-retaining amount, oil-absorbing rate, and wiping function which are demanded to such as facial tissue products. This excellence in such as oil-retaining amount, oil-absorbing rate, and wiping function, based on the more excellent "fluffy feel", favorably takes effect not only when the embossed crepe paper of the present invention is in a wound state such as toilet paper but also when this paper is released from the wound state or folded as it is one ply, and then put into a piled state.

According the present invention, when the wet-conditioned raw crepe paper is embossed, if the moisture-retaining component exists, then the moist feel is enhanced, and if the softening component exists, then the fluffy feel is enhanced. If the moisture-retaining component and the softening component and further, according to circumstances, the adhesive component are jointly used, then there can be obtained a product which is excellent in the properties such as strength, bulkiness, oil-retaining amount, oil-absorbing rate, softness, fluffy feel, and moist feel.

EXPLANATION OF THE SYMBOLS

| | |
|---|---|
| 10 | Raw crepe paper |
| 12 | Raw paper roll |
| 20 | Assistant-agent-liquid-supplying portion |
| 22 | Assistant agent liquid |
| 30 | Water-supplying portion |
| 40 | Embossing portion |
| 42 | Embossing roll |
| 48 | Heat embossing roll |
| 50 | Drying portion |
| 60 | Paper-separating portion |
| 70 | Product roll |

DETAILED DESCRIPTION OF THE INVENTION

Figure 1:
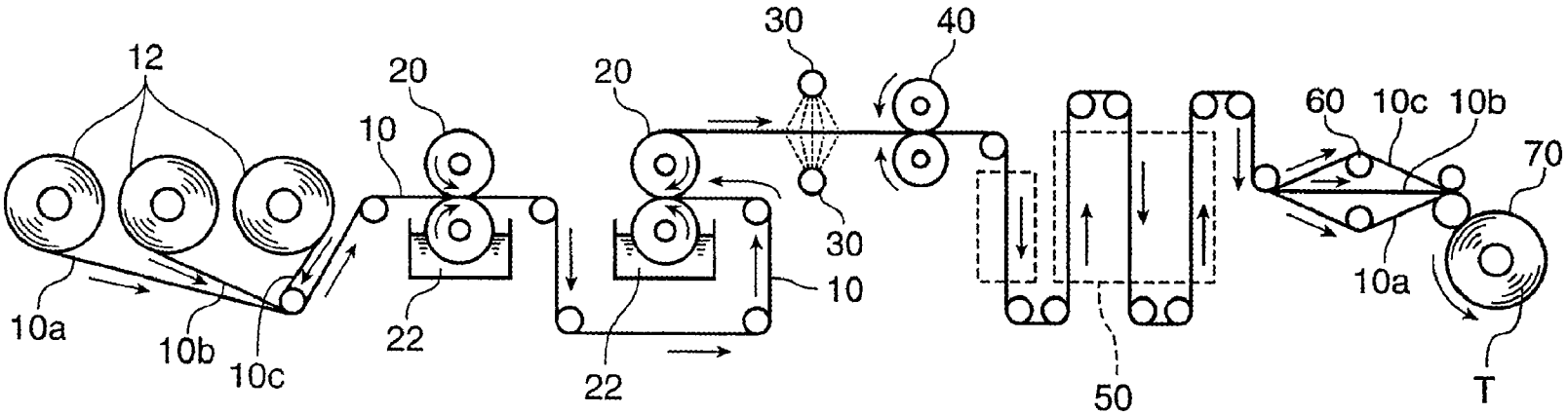
FIG. 1 is a diagram of the arrangement and structure of a manufacturing apparatus showing a working mode of the present invention.

[Constitution of Manufacturing Line]:

FIG. 1 schematically shows a manufacturing line for an embossed crepe paper T which is a assistant-agent-impregnated embossed crepe paper to be such as a three-ply moisture-retaining tissue.

Three raw paper rolls 12 are installed most upstream of the manufacturing line. Band-shaped raw crepe papers 10*a*, 10*b* and 10*c* are pulled out from each raw paper roll 12 and made into three-ply to thus continuously run a three-ply raw crepe paper 10.

Assistant-agent-liquid-supplying portions 20 are located downstream of the raw paper rolls 12. Each assistant-agent-liquid-supplying portion 20 applies an assistant agent liquid 22 (stored in a storage tank) to the raw crepe paper 10 which passes between a pair of application rolls. The assistant agent liquid 22 is applied to the surface side of the raw crepe paper 10 which surface side contacts with the application roll on the side to which the assistant agent liquid 22 is supplied. Thus, the assistant agent liquid 22 is sequentially applied to both sides of the raw crepe paper 10 in the assistant-agent-liquid-supplying portions 20 located in two places. As a result, the assistant agent liquid 22 is absorbed and supported over the entireties of the raw crepe papers 10*a* to 10*c* being the layers constituting the raw crepe paper 10. Though there is a case where water is mixed into the assistant agent liquid 22 together with the moisture-retaining component such as glycerol, the softening component such as stearyl alcohol, and/or the adhesive component such as CMC-Na, yet the amount of moisture that is included in the assistant agent liquid 22 is relatively small.

A water-supplying portion 30 is placed downstream of the assistant-agent-liquid-supplying portions 20. Water is showered from shower pipes (which are placed throughout the entire width of the raw crepe paper 10) onto both the upside and downside of the running raw crepe paper 10, so that water is supplied to the entirety of the raw crepe paper 10 to thus make it absorb and hold the water. The raw crepe paper 10 that has absorbed water comes in a condition where hydrogen bonding between fibers is loosened a little.

An embossing portion 40 is placed downstream of the water-supplying portion 30. There is embossed the running raw crepe paper 10, so that the raw crepe paper 10 which has been put in a wet condition by the absorbing and holding of water becomes embossed. The fibers between which the hydrogen bonding has been loosened a little as a result of the water absorption can move each other relatively easily inside the raw crepe paper 10, so that even the fine embossed shapes are provided clearly. However, immediately after the water has been supplied, water is not taken so far as inside the fibers themselves, and therefore, the swelling of the fibers is not caused.

A drying portion 50 such as a drying room is placed downstream of the embossing portion 40. The drying portion 50 heats the raw crepe paper 10 with a heater or blows it with hot wind while running the raw crepe paper 10, whereby the water absorbed and held by the raw crepe paper 10 is evaporated and quickly dried. The hydrogen bonding which has been loosened as a result of the absorption of water becomes recombined, and as a result, the embossed shapes are quickly fixed as they are.

A paper-separating portion 60 is placed downstream of the drying portion 50. The raw crepe paper 10 which has been embossed in the three-ply state is once separated into individual raw papers 10*a*, 10*b* and 10*c*, which are then piled on each other again. In this operation, when the embossed shapes in the upper and lower raw papers 10*a* . . . are separated from each other and then piled on each other again, the positions of the upper and lower embossed shapes are slightly mutually shifted, whereby gaps are created between the raw papers 10*a* . . . . As a result, the entire bulkiness of the raw crepe paper 10 increases.

A recovering roll 70 for recovering and holding the embossed crepe paper T which has been impregnated with the assistant agent and embossed is placed on the downstream side of the paper-separating portion 60.

The recovering roll 70 will be sent to the next manufacturing step or sent to the transporting or storing operation, if necessary.

In the working mode of FIG. 1, after embossed, pieces of the raw crepe paper may be piled on each other and then sent into the drying portion.

Figure 2:
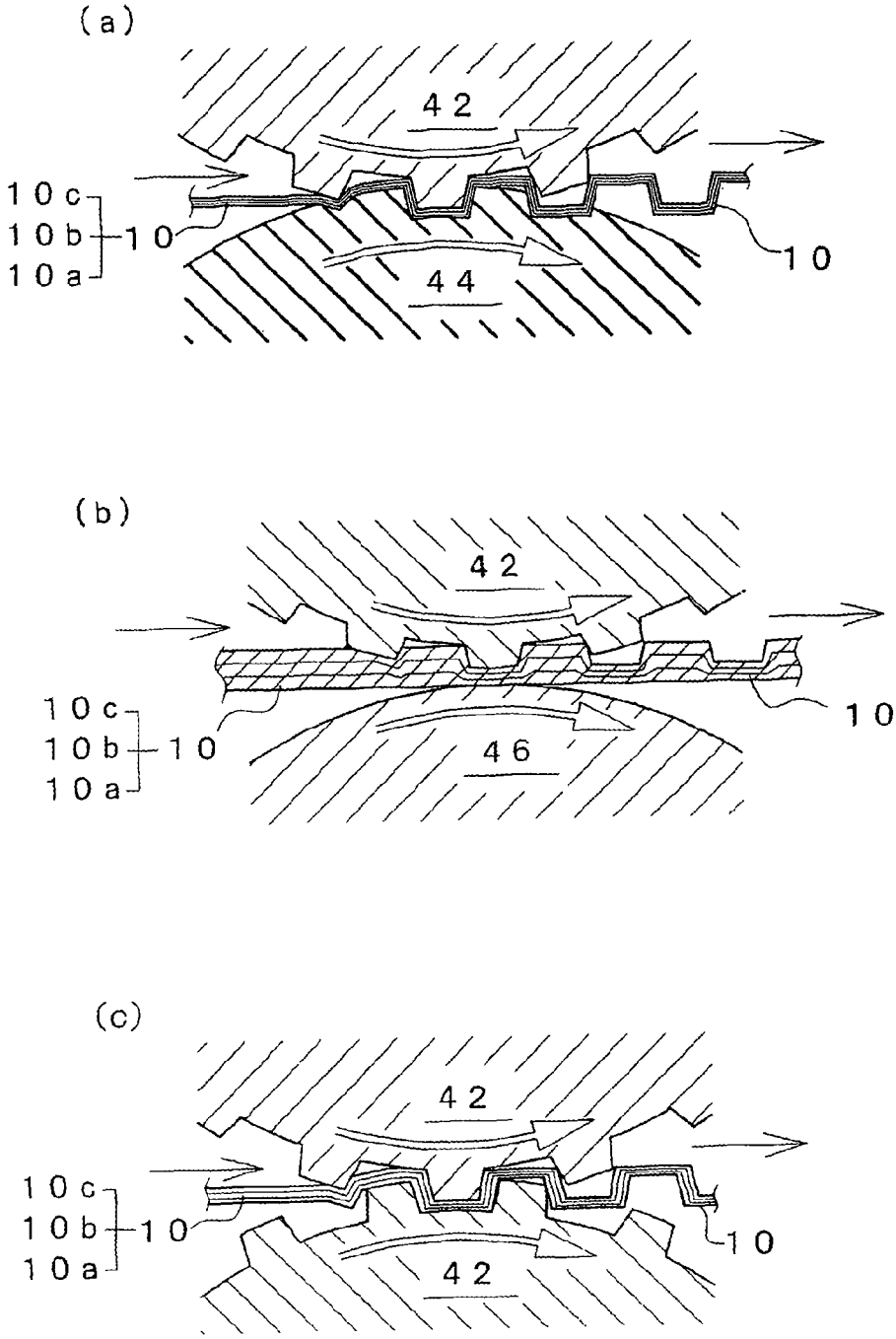
FIG. 2 is an enlarged structural diagram of a main portion showing the embossment.

[Details of Embossing]:

As shown in FIG. 2, there are three types of modes.

As shown in FIG. 2(*a*), if the raw crepe paper 10 is sandwiched between an embossing roll 42 made of a hard material (e.g. steel) with a surface having embossed shapes formed for embossment and a supporting roll 44 made of an elastically deformable material (e.g. rubber) with a flat surface, then not only the raw crepe paper 10 but also the surface of the supporting roll 44 is deformed in accordance with the embossed shapes of the embossing roll 42. Embossed shapes are formed on the raw crepe paper 10, which is thus embossed. The raw crepe paper 10 is deformed so as to be bent up and down without changing its thickness itself very much, so that the embossed shapes are formed on both the upper and lower sides in almost the same thickness.

In FIG. 2(*b*), a supporting roll 46 made of the same hard material as of the embossing roll 42, is used instead of the elastically deformable supporting roll 44. In this case, the downside of the raw crepe paper 10 maintains a flat state in accordance with the surface of the flat supporting roll 46. Since the size of the clearance between the embossed shape of the embossing roll 42 and the supporting roll 46 periodically changes, embossed shapes which correspond to the embossed shapes of the embossing roll 42 are formed on the upside of the raw crepe paper 10, and at the same time, the thickness of the raw crepe paper 10 changes in accordance with the embossed shapes of the surface. In the case of a three-ply raw crepe paper 10, the raw paper 10*c* on the embossing roll 42 side is subjected to embossment shaping such as waves much up and down, and its change of thickness is also made. As to the raw paper 10*a* which is close to the supporting roll 46, its downside remains flat, and only a change of thickness is made intermittently.

However, the modes of FIG. 2(*a*) and FIG. 2(*b*) are shown in a schematic and simplified manner for the sake of easily illustrating the difference between them. In actual embossments, there are many cases where a mode intermediate between them is carried out. In particular, also in the case where in FIG. 2(*a*) a rubber-made supporting roll 44 is used, some degree of change often occurs also to the thickness of the raw crepe paper 10 intermittently in accordance with the embossed shapes.

Furthermore, in FIG. 2(*c*), embossing rolls 42 and 42 having embossed shapes for embossment on the surface are used as both a pair of rolls. However, the arrangement of the embossed shapes is shifted between a pair of embossing rolls 42 and 42. If the raw crepe paper 10 is embossed using such a pair of embossing rolls 42 and 42, then concave shapes are alternately formed on the surface side and the back side by the embossment. As for the arrangement of the embossed shapes in the embossing rolls 42 and 42, the distance between the top of the mountain shape on one roll and the valley bottom in the other roll is set to be small, and the distance between the side of the mountain shape on one roll and the side of the mountain shape on the other roll is set to be great. As a result, in the embossed shapes, the thickness of the bottom portions of the concave shapes is smaller than that of their opposite side portions, and thus, differences in thickness are partly made.

In the above described embossing, the change of thickness of the raw crepe paper 10 can be made large or small, for example, by adjusting the clearance between a pair of rolls such as the embossing roll 42 and the supporting roll 44 or by adjusting the pressure to be applied.

By making such a change of thickness, it becomes easy for the oil-absorbed state to be visually recognized when the manufactured embossed crepe paper is used for tissue products or the like. That is to say, the difference in the thickness is related to the difference in the density of paper. In portions having a small thickness and high density, the oil-absorbing rate is so fast that the amount of absorbed oil easily reaches saturation. The saturated oil stays between pulp fibers, so that these portions become transparent. The amount of absorbed oil has not yet reached saturation in the surrounding portions having a low density, which therefore do not become transparent. As a result; portions having different transparencies or colors are partly created in the paper. Portions that have absorbed oil can be clearly recognized by the eye. For example, if, when tissue is used, portions that have not yet absorbed oil are used sequentially while portions that have absorbed oil are avoided, then it becomes possible to use the entire tissue efficiently. In addition, the amount of absorbed oil as a whole can be increased by stagnating oil in spaces made in gaps of the embossed shapes.

Incidentally, in the above described treatment by the paper-separating portion 60, the raw crepe paper 10 being in a state where the embossed shapes of the three raw papers 10*a* to 10*c* are exactly piled on each other by the embossment as shown in FIGS. 2(*a*) to 2(*c*) is separated into the raw papers 10*a* to 10*c* upward and downward, which are thereafter piled on each other again, so that their embossed shapes are piled on each other in a state slightly mutually shifted in the horizontal direction, whereby very small gaps are formed between the raw papers 10*a* to 10*c*. As a result, the bulkiness becomes much greater than that of the paper immediately after the embossments of FIGS. 2(*a*) to 2(*c*).

Figure 3:
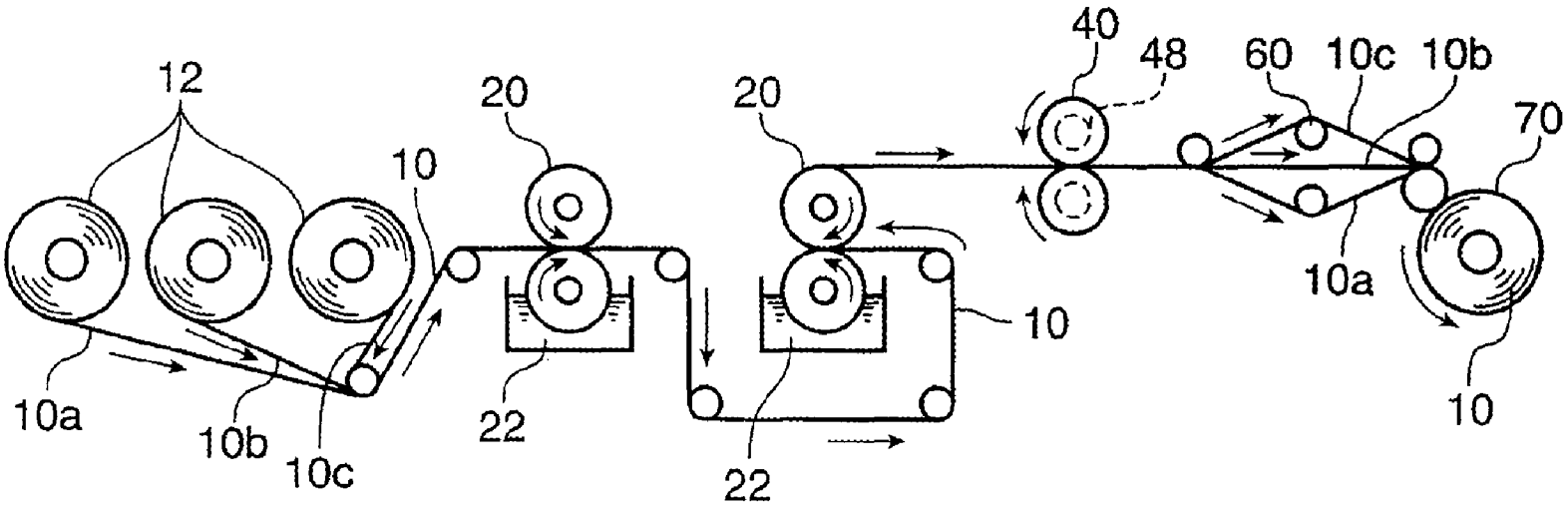
FIG. 3 is a diagram of the arrangement and structure of a manufacturing apparatus showing another working mode.

[Another Working Mode 1]:

In the manufacturing line shown in FIG. 3, the constitution of the apparatus is a little different from the above described working mode of FIG. 1. Descriptions are omitted about portions common to the aforementioned ones and given mainly about different constitutions.

It is the same as the aforementioned working mode that: three raw paper rolls 12 are installed most upstream, and therefrom three raw crepe papers 10*a*, 10*b* and 10*c* are drawn out, and a three-ply raw crepe paper 10 is supplied.

The assistant-agent-liquid-supplying portions 20 arranged in two places downstream of the raw paper rolls 12 are also common to the aforementioned working mode. However, as the assistant agent liquid 22 that is supplied in the assistant-agent-liquid-supplying portions 20, there is used an assistant agent liquid 22 which includes a relatively large amount of water in addition to the assistant agent such as the moisture-retaining component. Accordingly, a sufficient amount of water is supplied to the raw crepe paper 10 in addition to the assistant agent. The raw crepe paper 10 comes in a condition having absorbed and supported water.

An embossing portion 40 which is located on the downstream side of the assistant-agent-liquid-supplying portions 20 is different from the aforementioned working mode in the point of being provided with a heat embossing roll 48.

The heat embossing roll 48 is basically, as aforementioned, made of such as metal material and has embossed shapes on the surface and is provided with a heating mechanism (e.g. electrical heater) inside. The surface of the roll is in a heated state. Therefore, the raw crepe paper 10 is heated at the same time as being embossed. The heated raw crepe paper 10 is quickly dried by evaporation of water.

That is to say, the embossing and the drying are carried out almost simultaneously. Strictly speaking, it is difficult for water to evaporate from the raw crepe paper 10 in a state where the top and bottom of the raw crepe paper 10 are pinched between the embossing rolls. Therefore, it can be considered that the evaporation of water from the heated raw crepe paper 10, in other words, the drying, starts when the raw crepe paper 10 has been released from the embossing rolls.

It is common to the aforementioned working mode that the paper-separating portion 60 and the recovering roll 70 are located on the downstream side of the embossing portion 40. The embossed crepe paper T having been impregnated with the assistant agent and embossed is recovered by the recovering roll 70.

Figure 4:
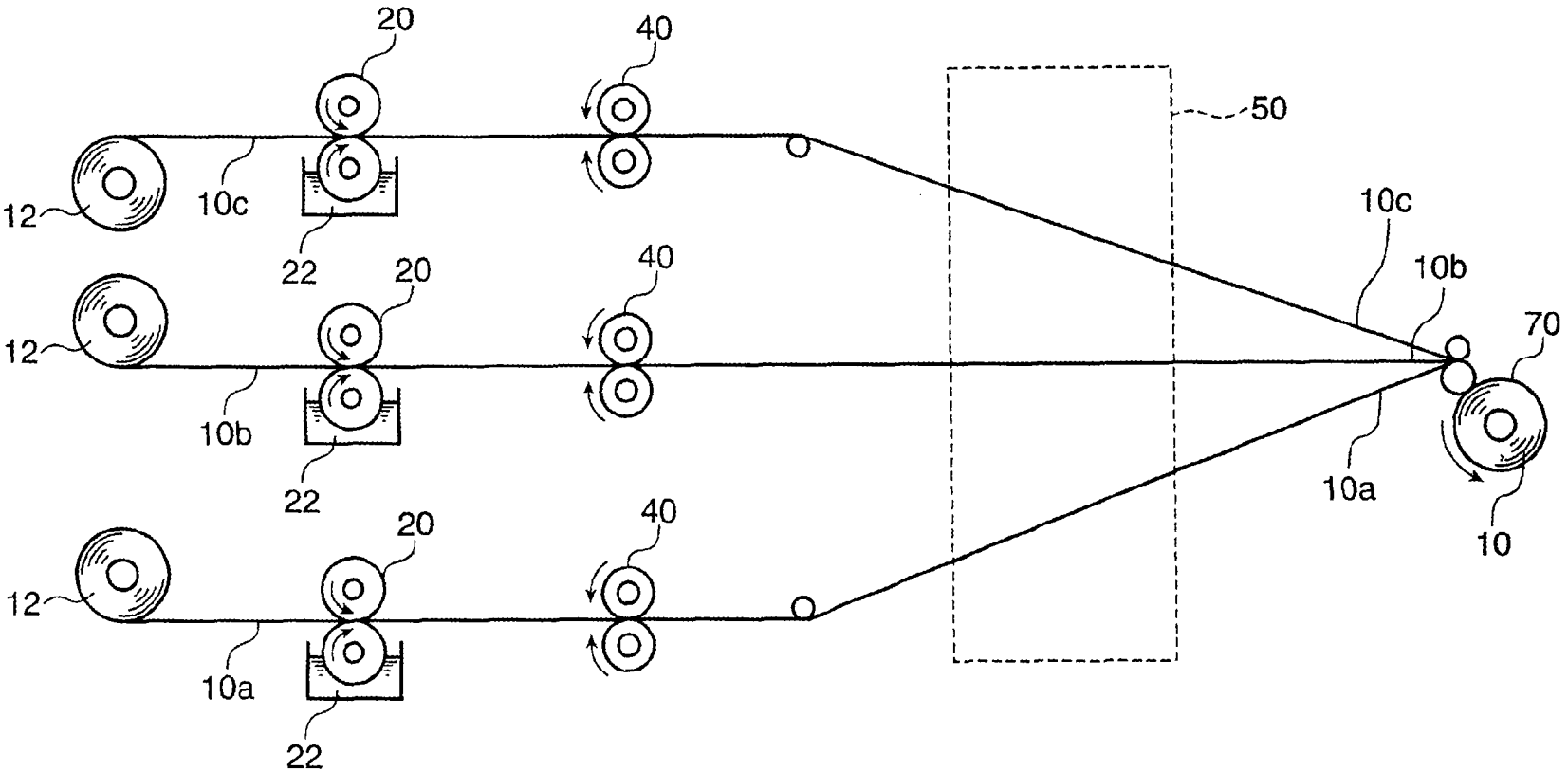
FIG. 4 is a diagram of the arrangement and structure of a manufacturing apparatus showing another working mode.

[Another Working Mode 2]:

In that the three raw crepe papers 10*a*, 10*b* and 10*c* are individually separately embossed in three embossing portions 40, the manufacturing line shown in FIG. 4 is different from the working mode of FIG. 3 in which the three raw crepe papers are embossed together. Accordingly, descriptions are omitted about portions common to the working modes of FIGS. 1 and 3.

In the working mode of FIG. 4, the separately embossed raw crepe papers are dried in the drying portion 50 and then piled on each other, but may, after embossed, be piled on each other and then sent into the drying portion 50. In addition, as in FIG. 3, the embossing and the drying may be combined together by the heat embossing roll 48.

If raw crepe papers are embossed in a state piled on each other, then according to such as the types of the raw crepe papers there is a case where because of large thickness, it is difficult to provide them with embossed shapes exactly as designed. If three-ply raw paper is embossed as in FIG. 3, then there is a case where the embossed shapes of the middle raw paper lack clearness. In that respect, if raw crepe papers are individually separately embossed as in FIG. 4, then clear embossed shapes can always be obtained.

DETAILED DESCRIPTION OF THE PREFERRED EMBODIMENTS

Embossed crepe papers were concretely manufactured, and their properties and performances were evaluated.

[Measuring Methods]:

<Amount of Water Supplied>:

The weight of water supplied was measured by subtracting the weight of the water-unsupplied raw crepe paper from the weight of the water-supplied raw crepe paper and indicated in % based on the weight of the raw crepe paper.

In the case where an assistant agent liquid which contains water was used, the amount of water originally included in the assistant agent liquid, the amount of water added to the assistant agent liquid in the test, and the total of these amounts of water were individually measured or calculated.

<Embossed Shapes>:

An embossed crepe paper resulting from the completion of the embossing was observed, and the clarity of the embossed shapes was evaluated in accordance with the following standard.

○: clear, Δ: somewhat clear, ×: unclear

<Tensile Strength>:

The tensile strength (N) in the longitudinal direction of the dry-conditioned paper was measured in accordance with the test for tensile strength of tissues prescribed in JIS-S3104 (1999).

<Breaking Length>:

The breaking length was determined from the longitudinal tensile strength (N) by the following formula:

$$\text{Breaking length (km)} = \text{longitudinal tensile strength } (N) \times 1000 / (9.81 \times \text{width of test piece (25 mm} \times 2) \times \text{basis weight (g/m}^2))$$

<Apparent Density>:

A test for compression properties was performed in accordance with a conventional method, and the apparent density was calculated from the measured thickness and basis weight of the paper in accordance with the following formula.

$$\text{Apparent density (g/cm}^3) = \text{basis weight (g/m}^2)/[\text{thickness (mm)} \times 1000]$$

wherein the basis weight of the paper is the metric basis weight as prescribed in JIS-P8124. However, in the calculation of the apparent density, the basis weight of the crepe paper impregnated with the assistant agent means the basis weight of only the crepe paper excluding the assistant agent.

The thickness of the paper was measured using a compression tester KES-FB3 (product name, made by Kato Tech Co., Ltd.). The measurement conditions were set as follows: standard high sensitive measurement, plate for applying the pressure: 2 $cm^2$, rate of compression: 0.0067 mm/s.

The measured value was determined under each of the following measurement conditions. In both cases, the smaller the apparent density is, the more excellent the bulkiness is.

Without load: the test for compression properties was performed under a measurement load of 0.5 $gf/cm^2$, which can be regarded as substantially no load.

Under load: the test for compression properties was carried out under a measurement load of 10 $gf/cm^2$. This is a load condition close to a state of a load applied when skin is wiped with the paper held in a hand when being actually used.

During the compression: a pressure of 100 $gf/cm^2$ was applied to the paper for one minute to thereby compress and deform the paper and then released before the test for compression properties, and then after one minute, the test for compression properties was performed. The recovering performance from the compression deformation is evaluated.

<Amount of Oil Retained>:

Oil for testing was reserved within a vat, and a paper sample was sufficiently immersed in the oil within the vat and then taken out. The sample that had been taken out was placed on a metal mesh having been disposed so as to be inclined at 30 degrees to a horizontal plane, and then left stationary for two minutes. After that, the weight of the sample retaining the oil was measured. The weight of the oil retained by the sample was determined from the weight of the untested sample. The magnification of the weight of the oil relative to the basis weight of the sample is taken as the amount of oil retained (times). The larger the amount of oil retained is, the larger amount of oil or the like the paper can absorb.

A liquid paraffin (Crystol N72, made by Exxon Mobil Oil Corporation) was used as the oil for the test to perform the test at a temperature of 23° C.

<Rate of Oil Absorption>:

The rate of oil absorption was measured in accordance with the test for water absorbency of tissues as prescribed in JIS-S3104 (1999). Oil [liquid paraffin (Crystol N72, made by Exxon Mobil Oil Corporation)] was used instead of water, and the rate of oil absorption was measured by setting the temperature at 23° C. and the dropping amount at 0.03 ml. The measured value was represented by the rate (s) of oil absorption. The shorter the rate (s) of oil absorption is, the more quickly the oil can be absorbed.

<Softness>:

The softness was measured under the following conditions in accordance with the testing method as prescribed in "Paper—Determination of Softness, JAPAN TAPPI NO. 34".

A sample was pushed into a slit of .a tester, when the force of resistance (mN/100 mm) was measured. The force was measured in each of the longitudinal direction and the lateral direction of the sample, and the average value thereof was determined. The smaller the numerical value is, the smaller the resistance is and the softer the paper is judged to be.

Tester: Handle-o-meter (made by Kumagai Riki Kogyo Co., Ltd.), dimensions of sample: 10×10 cm; width of slit: 6.35 mm <Fluffy Feel>:

A feeling test was performed by ten monitors, and the paper was evaluated in accordance with the following standard, and the average points were determined.

Very fluffy: 4 points, fluffy: 3 points, somewhat fluffy: 2 points, not fluffy: 1 point <Processibility>:

Whether or not the running paper wrinkled during the embossing was observed, and the processibility was evaluated in accordance with the following standard.

Not wrinkled: ○, wrinkled: ×

EXAMPLE 1

<Raw Crepe Paper>:

A pulp material comprising a combination of 60 weight % of LBKP (bleached pulp gained in accordance with a hardwood kraft method) and 40 weight % of NBKP (bleached pulp gained in accordance with a softwood kraft method) was beaten so as to have a Canadian standard freeness of 620 ml to 630 ml, and then 0.2 weight % (relative to the pulp material) of a wet paper strength agent was added, and then a raw crepe paper was made in accordance with a conventional method.

The gained raw crepe paper had a basis weight of 13 $g/m^2$ and a crepe ratio of 18%.

<Manufacture of Embossed Crepe Paper>:

The dry-conditioned raw crepe paper was made into two-ply, and the amount of water listed in the following Table was sprayed onto the surface of the raw crepe paper and thereby absorbed. As for the amount of water supplied, its weight based on the weight of the raw crepe paper was shown in %.

The wet-conditioned raw crepe paper was embossed. For the embossing, an embossing apparatus having an embossing roll made of steel and a supporting roll made of rubber was used, and a pressure of 70 kPa was applied. The embossed pattern having been formed by the embossment had a square shape approximately 0.7 mm square, an embossed depth of approximately 0.08 mm, and 50 embossment units per $cm^2$.

The embossed raw crepe paper was dried by heating for one minute at 60° C. using a drying apparatus (heating by a heater). After the completion of the drying, the piled raw crepe papers were peeled of each other and then piled on each other again to gain an embossed tissue.

These treatment operations were continuously carried out while the raw crepe paper was run at 4 m/min.

The above described measuring tests were carried out about the manufactured embossed crepe paper.

COMPARATIVE EXAMPLE 1

As for comparative examples, the same tests were carried out also about the following: a case where a raw crepe paper being unsupplied with water and being in a state of equilibrium with the environmental moisture was used (Comparative Example 1-1); a case where a large amount of water was supplied to a raw crepe paper (Comparative Example 1-2); a case where a raw crepe paper into which a paper strength agent had been added was embossed without supplying the raw crepe paper with water (Comparative Example 1-3); and an unembossed raw crepe paper (raw paper). As to the raw crepe paper of Comparative Example 1-3, it was made by adding 2%, in terms of solid content based on the pulp, of a dry paper strength agent DS4336 (made by Seiko PMC Corporation).

The results of the tests are shown in the following Tables. Incidentally, in the Tables, the change ratio (%) relative to the raw paper is also shown in the following items: tensile strength, apparent density, amount of oil retained, and rate of oil absorption.

TABLE 1

<Comparison of performance: supply (1) of water>:

| | Example | | | | | | Raw |
|---|---|---|---|---|---|---|---|
| | 1-1 | 1-2 | 1-3 | 1-4 | 1-5 | 1-6 | paper |
| Amount of water supplied (%) | 0.5 | 1.0 | 5.0 | 10 | 20 | 50 | — |
| Embossed shapes | ○ | ○ | ○ | ○ | ○ | ○ | — |
| Tensile strength (N) | 4.80<br>8% | 4.73<br>6% | 4.94<br>11% | 5.01<br>12% | 5.23<br>17% | 5.19<br>16% | 4.46 |
| Breaking length (km) | 0.790 | 0.779 | 0.813 | 0.825 | 0.861 | 0.855 | 0.734 |
| Apparent density ($g/cm^3$) | | | | | | | |
| without load | 0.050<br>−36% | 0.049<br>−37% | 0.052<br>−33% | 0.047<br>−40% | 0.044<br>−44% | 0.046<br>−41% | 0.078 |
| under load | 0.076<br>−34% | 0.076<br>−34% | 0.071<br>−38% | 0.065<br>−43% | 0.060<br>−48% | 0.065<br>−43% | 0.115 |
| after compression: without load | 0.054<br>−44% | 0.060<br>−38% | 0.057<br>−41% | 0.050<br>−48% | 0.051<br>−47% | 0.054<br>−44% | 0.097 |
| after compression: under load | 0.093<br>−25% | 0.093<br>−25% | 0.088<br>−29% | 0.070<br>−44% | 0.070<br>−44% | 0.077<br>−38% | 0.124 |
| Amount of oil retained (times) | 8.47<br>24% | 8.33<br>22% | 8.63<br>26% | 8.70<br>27% | 8.49<br>24% | 8.48<br>24% | 6.85 |
| Rate of oil absorption (s) | 1.8<br>−38% | 1.5<br>−48% | 1.8<br>−38% | 2.0<br>−31% | 1.7<br>−41% | 1.5<br>−48% | 2.9 |
| Softness (mN/100 mm) | 30 | 29 | 32 | 35 | 42 | 40 | 26 |
| Fluffy feel | 3.1 | 3.2 | 3.2 | 3.3 | 3.1 | 3.2 | 1.7 |
| Processibility | ○ | ○ | ○ | ○ | ○ | ○ | — |

TABLE 2

<Comparison of performance: supply (2) of water>:

| | Comparative Example | | |
|---|---|---|---|
| | 1-1 | 1-2 | 1-3 |
| Amount of water supplied (%) | 0 | 200 | 0 |
| Embossed shapes | Δ | — | ○ |
| Tensile strength (N) | 4.11<br>−8% | — | 10.0<br>124% |
| Breaking length (km) | 0.677 | — | 1.614 |
| Apparent density ($g/cm^3$) | | | |
| without load | 0.063<br>−19% | — | 0.051<br>−35% |
| under load | 0.107<br>−7% | — | 0.068<br>−41% |
| after compression: without load | 0.070<br>−28% | — | 0.060<br>−38% |
| after compression: under load | 0.114<br>−8% | — | 0.088<br>−29% |
| Amount of oil retained (times) | 7.77<br>13% | — | 8.16<br>19% |
| Rate of oil absorption (s) | 2.2<br>−24% | — | 1.8<br>−38% |
| Softness (mN/100 mm) | 27 | — | 90 |
| Fluffy feel | 2.2 | — | 1.0 |
| Processibility | ○ | X | ○ |

<Evaluation>:

(1) In the Examples where the wet-conditioned raw crepe paper was embossed, the embossed shapes were clear and the tensile strength was enhanced, when compared with Comparative Example 1-1 where the dry-conditioned raw crepe paper was embossed. The apparent density was small and the bulkiness was enhanced. The amount of oil retained is increased and the rate of oil absorption is also excellent. The fluffy feel is enhanced.

(2) As for the change ratio of each property value relative to the raw paper in the Examples, the tensile strength is increased by 6% to 17%, and the apparent density under load is decreased by 30% to 48%. The amount of oil retained is increased by 22% to 27%. As to the rate of oil absorption, oil can be absorbed in a period of time that is shorter by 31% to 48%.

It is industrially extremely useful that such great improvements of the properties can be achieved by the relatively simple operation of embossing the wet-conditioned raw crepe paper.

(3) Among the Examples, the difference in amount of water supplied makes a difference in each property.

For example, the tensile strength increases as the amount of water supplied increases, and it becomes the strongest when the amount of water supplied is 20% (Example 1-5), but it becomes a little weaker when the amount of water supplied is 50% (Example 1-6). In the case where a large amount of water was supplied such that the amount of water supplied became 200% as in Comparative Example 1-2, it became impossible to carry out the embossment.

The apparent density is a little different depending on the conditions for measurement, but totally the apparent density becomes the smallest and the bulkiness therefore becomes the most excellent when the amount of water supplied is close to 10% (Example 1-4) or 20% (Example 1-5).

(4) In Comparative Example 1-3, a raw crepe paper having a paper strength enhanced by adding the paper strength agent to thereby reinforce the bonding between fibers is used. The embossing could be carried out relatively well and the apparent density is also small, but the embossed paper is hard and inferior in the softness and the fluffy feel. It is difficult to utilize the embossed paper for uses where such as a good feel to the skin is required, such as tissue products.

EXAMPLE 2

<Moisture-Retaining Tissue: Two-Ply>:

A paper for manufacturing a moisture-retaining tissue "Avonlea Keith" (trade name, made by Kawano Paper Co., Ltd.) was used, wherein the paper was manufactured by making the same raw crepe paper as of the above described Example 1 into two-ply and then supporting thereon a moisture-retaining component. This moisture-retaining paper for tissue has a basis weight of 12.7 g/m$^2$ before the moisture-retaining processing and a basis weight of 15.6 g/m$^2$ after the moisture-retaining processing.

The moisture-retaining component comprises glycerol and sorbitol. In addition, the moisture-retaining liquid for supplying the moisture-retaining component also included water, but the raw crepe paper was left for a sufficient period of time after the moisture-retaining liquid was supplied thereto. As a result, the moisture-retaining paper for tissue is in a state where moisture being in a state of equilibrium with moisture in the environment is included in the moisture-retaining component.

<Manufacture of Embossed Moisture-Retaining Paper for Tissue>:

The amount of water shown in the following Table was sprayed onto the moisture-retaining paper for tissue and thereby absorbed. As for the amount of water supplied, its weight based on the weight of the moisture-retaining paper for tissue was shown in %.

In the same manner as in Example 1, the wet-conditioned moisture-retaining paper for tissue was embossed, dried, separated into every ply, and then piled on each other again to gain an embossed moisture-retaining tissue.

The same tests as those for Example 1 were performed about the manufactured embossed moisture-retaining tissue.

COMPARATIVE EXAMPLE 2

Comparative Example 2-1 is a case where no water is supplied and the drying is not carried out after the embossment. In Comparative Example 2-2, a raw crepe paper obtained by applying the same moisture-retaining processing as of the aforementioned moisture-retaining tissue "Avonlea Keith" to a raw paper into which a paper strength agent had been added was used as a moisture-retaining raw paper for tissue and embossed without supplying any water, wherein similarly to Comparative Example 1-3, the raw paper was made by adding 2%, in terms of solid content based on the pulp, of a dry paper strength agent DS4336 (made by Seiko PMC Corporation).

The results of the tests are shown in the following Table. In this Table, the raw paper means a moisture-retaining paper for tissue, that is, a moisture-retaining-component-containing raw crepe paper.

TABLE 3

<Comparison of performance: moisture-retaining tissue (two-ply)>:

| | Example | | | Comparative Example | | Raw |
|---|---|---|---|---|---|---|
| | 2-1 | 2-2 | 2-3 | 2-1 | 2-2 | paper |
| Amount of water supplied (%) | 1.0 | 5.0 | 10 | 0 | 0 | — |
| Embossed shapes | ○ | ○ | ○ | X | ○ | — |
| Tensile strength (N) | 2.57<br>6% | 2.61<br>8% | 2.54<br>5% | 2.33<br>−4% | 5.12<br>112% | 2.42 |
| Breaking length (km) | 0.353 | 0.358 | 0.349 | 0.320 | 0.691 | 0.332 |
| Apparent density (g/cm$^3$) | | | | | | |
| without load | 0.058<br>−48% | 0.060<br>−46% | 0.060<br>−46% | 0.075<br>−33% | 0.060<br>−46% | 0.112 |
| under load | 0.105<br>−31% | 0.102<br>−33% | 0.088<br>−42% | 0.141<br>−7% | 0.091<br>−40% | 0.152 |
| after compression: without load | 0.079<br>−48% | 0.072<br>−53% | 0.064<br>−58% | 0.096<br>−37% | 0.071<br>−53% | 0.152 |
| after compression: under load | 0.137<br>−27% | 0.133<br>−29% | 0.118<br>−37% | 0.159<br>−15% | 0.117<br>−38% | 0.188 |
| Amount of oil retained (times) | 8.00<br>32% | 8.22<br>35% | 7.95<br>31% | 7.15<br>18% | 7.63<br>25% | 6.08 |
| Rate of oil absorption (s) | 3.7<br>−68% | 3.8<br>−67% | 3.7<br>−68% | 6.2<br>−47% | 3.9<br>−66% | 11.6 |
| Softness (mN/100 mm) | 23 | 24 | 26 | 21 | 51 | 20 |
| Fluffy feel | 3.6 | 3.6 | 3.8 | 2.1 | 1.2 | 1.5 |
| Processibility | ○ | ○ | ○ | ○ | ○ | — |

<Evaluation>:

(1) Also in the case of the moisture-retaining paper for tissue of Example 2 similarly to the raw crepe paper of Example 1, it has proven to be useful to carry out the embossment in a wet condition.

(2) As for the change ratio of each property value relative to the unembossed moisture-retaining paper for tissue (raw paper), the tensile strength is increased by 5% to 8%, and the apparent density under load is decreased by 31% to 42%. The amount of oil retained is increased by 31% to 35%. As to the rate of oil absorption, oil can be absorbed in a period of time that is shorter by as much as 67% to 68%.

It has hitherto been considered unavoidable that moisture-retaining tissue products are inferior to conventional tissue products in respect to properties such as strength. However, if the above improvements of the properties can be achieved, then it follows that they can greatly contribute to the enhancement of the performance of the moisture-retaining tissue products and to their extension to new uses.

(3) In Comparative Example 2-2 similarly to the above described Comparative Example 1-3, the paper has a high strength and is hard so that the embossed shapes are clear and the apparent density is also lowered even if water is not supplied. However, the softness and the fluffy feel are so inferior that the commercial value as a tissue product is inferior.

EXAMPLE 3

<Moisture-Retaining Tissue: Three-Ply>:

A paper, comprising a three-ply raw crepe paper, for manufacturing a moisture-retaining tissue "Fu-fu-fu" (trade name, made by Kawano Paper Co., Ltd.) was used. This paper has a basis weight of 11.0 g/m$^2$ before the moisture-retaining processing and a basis weight of 12.0 g/m$^2$ after the moisture-retaining processing.

<Manufacture of Embossed Moisture-Retaining Paper for Tissue>:

An embossed moisture-retaining tissue was gained via the steps common to Example 2. The same tests as those for Example 1 were performed about the manufactured embossed moisture-retaining tissue.

COMPARATIVE EXAMPLE 3

Comparative Example 3-1 is a case where no water was supplied. Comparative Example 2-2 is a case where a raw crepe paper obtained by applying the same moisture-retaining processing as of the aforementioned moisture-retaining tissue "Fu-fu-fu" to a raw paper into which a paper strength agent had been added was used as a moisture-retaining raw paper for tissue and embossed without supplying any water, wherein similarly to Comparative Example 1-3, the raw paper was made by adding 2%, in terms of solid content based on the pulp, of a dry paper strength agent DS4336 (made by Seiko PMC Corporation).

The results of the tests are shown in the following Table. In this Table, the raw paper means a moisture-retaining paper for tissue, that is, a moisture-retaining-component-containing raw crepe paper.

TABLE 4

<Comparison of performance: moisture-retaining tissue (three-ply)>:

| | Example | | | Comparative Example | | Raw |
|---|---|---|---|---|---|---|
| | 3-1 | 3-2 | 3-3 | 3-1 | 3-2 | paper |
| Amount of water supplied (%) | 1.0 | 5.0 | 10 | 0 | 0 | — |
| Embossed shapes | ○ | ○ | ○ | X | ○ | — |
| Tensile strength (N) | 2.84<br>11% | 2.91<br>14% | 3.15<br>24% | 2.38<br>−7% | 6.94<br>172% | 2.55 |
| Breaking length (km) | 0.507 | 0.519 | 0.562 | 0.424 | 1.214 | 0.455 |
| Apparent density (g/cm$^3$) | | | | | | |
| without load | 0.054<br>−35% | 0.063<br>−24% | 0.045<br>−46% | 0.065<br>−22% | 0.058<br>−30% | 0.083 |
| under load | 0.107<br>−11% | 0.096<br>−20% | 0.078<br>−35% | 0.116<br>−3% | 0.103<br>−14% | 0.120 |
| after compression: without load | 0.068<br>−29% | 0.066<br>−31% | 0.059<br>−39% | 0.070<br>−27% | 0.066<br>−31% | 0.096 |
| after compression: under load | 0.118<br>−6% | 0.113<br>−10% | 0.099<br>−21% | 0.120<br>−4% | 0.104<br>−17% | 0.125 |
| Amount of oil retained (times) | 11.84<br>50% | 11.90<br>51% | 11.40<br>45% | 9.53<br>21% | 10.37<br>32% | 7.87 |
| Rate of oil absorption (s) | 0.9<br>−64% | 1.0<br>−60% | 1.1<br>−56% | 1.8<br>−28% | 1.2<br>−52% | 2.5 |
| Softness (mN/100 mm) | 26 | 26 | 29 | 22 | 71 | 23 |
| Fluffy feel | 3.6 | 3.6 | 3.8 | 2.1 | 1.2 | 1.5 |
| Processibility | ○ | ○ | ○ | ○ | ○ | — |

<Evaluation>:

(1) Also as to the moisture-retaining paper for tissue (three-ply) similarly to the moisture-retaining paper for tissue (two-ply) of Example 2, it is very useful to carry out the embossment in a wet condition.

(2) As for the change ratio of each property value relative to the unembossed moisture-retaining paper for tissue (raw paper), the tensile strength is increased by 11% to 24%, and the apparent density under load is decreased by 11% to 35%. The amount of oil retained is increased by 45% to 51%. As to the rate of oil absorption, oil can be absorbed in a period of time that is shorter by as much as 56% to 64%.

(3) From comparison with Example 2, it can be understood that as to the moisture-retaining paper for tissue, a three-ply one is superior to a two-ply one in respect to the amount of oil retained and the rate of oil absorption. In addition, the reason why the degree of the increase in the amount of oil retained is higher than the change in the density is that the amount of oil retained of the unembossed moisture-retaining paper for tissue is small, because as to the unembossed moisture-retaining paper for tissue, when impregnated with oil, paper layers are tensed by the tension of the oil, so that spaces between paper layers cannot be kept. However, if structural spaces are formed between paper layers by the embossment, then it becomes possible to keep spaces which retain the oil against its tension, so that the amount of oil retained is greatly increased. In this way, the effects of applying the embossment to the moisture-retaining paper for tissue are remarkably expressed.

(4) In Comparative Example 3-2 similarly to the above described Comparative Example 1-3, the paper has a high strength and is hard so that the embossed shapes are clear and the apparent density is also lowered even if water is not supplied. However, the softness and the fluffy feel are so inferior that the commercial value as a tissue product is inferior.

EXAMPLE 4

<Supply of Moisture-Retaining Liquid and Water>:

A moisture-retaining liquid comprising glycerol, sorbitol and water in a weight ratio of 6:2:3 was used. The moisture-retaining-liquid-supplying portions and the water-supplying portion having their respective structures shown in FIG. 1 were used, and the moisture-retaining liquid and water were supplied to the raw crepe paper. Gravure printing rolls were used for supplying the moisture-retaining liquid.

In Examples 4-1 to 4-3, the amount of water supplied is different, but the amount of the moisture-retaining liquid supplied is the same. An amount of 6 weight % of glycerol and 2 weight % of sorbitol relative to the weight of the raw crepe paper are retained as the moisture-retaining components, and water included in the moisture-retaining liquid is supplied in an amount of 3 weight % relative to the weight of the raw crepe paper. Unlike in Examples 2 and 3, no drying treatment is carried out after supplying the moisture-retaining liquid, and subsequently water is supplied. Therefore, the raw crepe paper comes in a state where water has been supplied thereto in the total amount of water supplied which is the sum total of the amount of additional water additionally supplied and the water content of the moisture-retaining liquid.

<Manufacture of Embossed Crepe Paper>:

An embossed crepe paper was manufactured by the same process as of the above described Examples. The gained embossed crepe paper is an embossed moisture-retaining tissue which holds the moisture-retaining components.

The results of the tests are shown in the following Table.

TABLE 5

<Supply of water by moisture-retaining liquid>:

| | Example | | |
|---|---|---|---|
| | 4-1 | 4-2 | 4-3 |
| Water content of moisture-retaining liquid % | 3.0 | 3.0 | 3.0 |
| Amount of additional water % | 1.0 | 5.0 | 10 |
| Total amount of water supplied % | 4.0 | 8.0 | 13 |
| Embossed shapes | ○ | ○ | ○ |
| Processibility | ○ | ○ | ○ |

<Evaluation>:

(1) It has been proven that embossed shapes can clearly be formed similarly to the above described Examples even if the supply of the moisture-retaining liquid and the supply of water are combined.

EXAMPLE 5

<Supply of Moisture-Retaining Liquid and Water>:

The moisture-retaining liquid and water were supplied to the raw crepe paper in the same manner as of Example 4.

However, in Example 5-1, after the application of the moisture-retaining liquid, the paper was left in the environment for 24 hours to thus put it in a state of equilibrium with the moisture in the environment, when the water content was 3%. In Example 5-2, 1.5% of water was additionally supplied to the state of Example 5-1.

<Manufacture of Embossed Crepe Paper>:

An embossed crepe paper was manufactured by the same process as of the above described Examples. However, a heat embossing roll was used for the embossment, so it was not necessary to carry out the drying step after the embossment.

The heat embossing roll was heated so that the temperature of the embossing surface became 60° C. The pressure was set at 70 kPa. The other treatment conditions were common to Example 1. The gained embossed crepe paper is an embossed moisture-retaining tissue which holds the moisture-retaining components.

The results of the tests are shown in the following Table.

TABLE 6

<Heat embossing>:

| | Example | |
|---|---|---|
| | 5-1 | 5-2 |
| Water content of moisture-retaining liquid % | 3.0 | 3.0 |
| Amount of additional water % | 0 | 1.5 |
| Total amount of water supplied % | 3.0 | 4.5 |
| Embossed shapes | ○ | ○ |
| Processibility | ○ | ○ |

<Evaluation>:

(1) It has been proven that if the embossment is carried out using a heat embossing roll, then the embossing step and the subsequent drying step can be carried out at the same time, and thus, the manufacturing process is simplified, and the embossment finishing as good as the above described Examples can be gained.

(2) In Example 5-1, the unembossed raw crepe paper contains only the equilibrium-conditioned moisture taken into the moisture-retaining component. Even in this case, if there is adopted a method such that the drying is made almost at the same time as the formation of the embossed shapes by making a heat source and a raw crepe paper cohere such as using a heat embossing roll, then the embossed shapes are formed well and also maintained after the drying. If the embossment by the heat embossing roll is applied to such a raw crepe paper on which the equilibrium-conditioned moisture-retaining component is supported, then water taken into the moisture-retaining component volatilizes, so that the paper comes in a dry condition. However, in the environment of the subsequent treatment steps, storage, distribution, and use, the moisture-retaining component absorbs moisture from the environment to thus return to the state of equilibrium again.

(3) It can also be considered applying the embossment by an embossing roll or heat embossing roll to a raw crepe paper being in a state of equilibrium with the environmental moisture by its absorption though not in a wet condition or to a raw crepe paper being on the way of moisture absorption and therefore unequilibrated. However, in such a raw crepe paper, no water to loosen or recombine hydrogen bonding between pulp fibers exists between them, so that no good embossment can be formed.

Hereinafter the difference in effect according to the difference in assistant agent was examined.

EXAMPLE 6

A raw crepe paper was made in the same way as of Example 1. The obtained raw crepe paper had a basis weight of 13.4 g/m$^2$ and a crepe ratio of 18%. The surface of this dry-conditioned raw crepe paper was sprayed with a solution containing an assistant agent and water shown in Table 7 to thus put the raw crepe paper in a wet condition, and then, in the same way as of Example 1, the raw crepe paper was embossed and made into two-ply to thus obtain crepe papers of Examples 6-1 to 6-7.

As to the assistant agent, glycerol was used as the moisture-retaining component, stearyl alcohol was used as the softening component, and CMC-Na was used as the adhesive component. Glycerol and CMC-Na were dissolved into water, and stearyl alcohol was made into an emulsion using as an emulsifier a mixture of monostearic acid polyoxyethylene (20) sorbitan and monostearic acid sorbitan in a weight ratio of 3:1.

The numerical value shown in Table 7 represents the impregnation ratio (weight %) based on the weight of the raw crepe paper.

COMPARATIVE EXAMPLE 6

Comparative Example 6-1 is a case where: the same raw crepe paper as of Example 6 was sprayed with a solution prepared by dissolving 1 part of stearyl alcohol into 20 parts of isopropyl alcohol so that the amount of the solution would be 21% based on the weight of the raw crepe paper, and thereafter the paper was left in a standard state (23° C., 50% RH) to volatilize isopropyl alcohol and made into two-ply without embossment, thus obtaining a crepe paper. Comparative Example 6-2 is a case where: to the raw crepe paper having ended the volatilization of isopropyl alcohol in Comparative Example 6-1, there was applied the same embossment as of Example 6 without supply of water, thus obtaining an embossed crepe paper.

The evaluation results are also shown in the lower portion of Table 7.

The evaluation of the "moist feel" in Table 7 was obtained in the following way.

<Moist Feel>:

A feeling test was performed by ten monitors, and the paper was evaluated in accordance with the following standard, and the average points were determined.

Very moist: 4 points, moist: 3 points, somewhat moist: 2 points, not moist: 1 point

TABLE 7

<Comparison of performance: impregnation (1) of assistant agent>:

| | Example | | | | Example | | | Comparative Example | |
|---|---|---|---|---|---|---|---|---|---|
| No. | 6-1 | 6-2 | 6-3 | 6-4 | 6-5 | 6-6 | 6-7 | 6-1 | 6-2 |
| Water | 20 | 20 | 20 | 20 | 20 | 20 | 20 | 0 | 0 |
| Glycerol | 0 | 10 | 0 | 10 | 10 | 0 | 10 | 0 | 0 |
| Emulsifier | 0 | 0 | 0.3 | 0.3 | 0 | 0.3 | 0.3 | 0 | 0 |
| Stearyl alcohol | 0 | 0 | 1 | 1 | 0 | 1 | 1 | 1 | 1 |
| CMC-Na | 0 | 0 | 0 | 0 | 0.1 | 0.1 | 0.1 | 0 | 0 |
| Isopropyl alcohol | 0 | 0 | 0 | 0 | 0 | 0 | 0 | 20 | 20 |
| Embossed shapes | ○ | ○ | ○ | ○ | ○ | ○ | ○ | — | Δ |
| Tensile strength (N) | 5.34 | 4.21 | 4.27 | 4.15 | 5.36 | 4.87 | 4.64 | 4.61 | 4.02 |
| % | 15.84 | −8.68 | −7.38 | −9.98 | 16.27 | 5.64 | 0.65 | | −12.80 |
| Breaking length (km) | 0.853 | 0.611 | 0.674 | 0.596 | 0.772 | 0.767 | 0.665 | 0.729 | 0.636 |
| Apparent density (g/cm$^3$) | | | | | | | | | |
| without load | 0.052 | 0.066 | 0.055 | 0.062 | 0.061 | 0.052 | 0.058 | 0.079 | 0.073 |
| % | −34.18 | −16.46 | −30.38 | −21.52 | −22.78 | −34.18 | −26.58 | | −7.59 |
| under load | 0.066 | 0.082 | 0.076 | 0.078 | 0.077 | 0.067 | 0.074 | 0.121 | 0.118 |
| % | −45.45 | −32.23 | −37.19 | −35.54 | −36.36 | −44.63 | −38.84 | | −2.48 |
| after compression: without load | 0.058 | 0.076 | 0.068 | 0.072 | 0.069 | 0.060 | 0.066 | 0.100 | 0.083 |
| % | −42.00 | −24.00 | −32.00 | −28.00 | −31.00 | −40.00 | −34.00 | | −17.00 |
| after compression: under load | 0.078 | 0.098 | 0.092 | 0.093 | 0.090 | 0.082 | 0.086 | 0.128 | 0.125 |
| % | −39.06 | −23.44 | −28.13 | −27.34 | −29.69 | −35.94 | −32.81 | | −2.34 |
| Amount of oil retained (times) | 8.66 | 7.72 | 7.93 | 7.97 | 8.23 | 8.07 | 7.82 | 6.62 | 7.33 |
| % | 30.82 | 16.62 | 19.79 | 20.39 | 24.32 | 21.90 | 18.13 | | 10.73 |
| Rate of oil absorption (s) | 1.7 | 1.9 | 1.8 | 2.0 | 1.8 | 2.3 | 2.2 | 3.3 | 2.9 |
| % | −48.48 | −42.42 | −45.45 | −39.39 | −45.45 | −30.30 | −33.33 | | −12.12 |
| Softness (mN/100 mm) | 38 | 30 | 32 | 27 | 35 | 39 | 32 | 30 | 34 |
| Fluffy feel | 2.7 | 2.5 | 3.3 | 3.6 | 2.8 | 3.5 | 3.9 | 1.7 | 2.2 |
| Moist feel | 1.5 | 3.1 | 2.3 | 3.6 | 2.8 | 2.1 | 3.6 | 1.0 | 1.2 |
| Processibility | ○ | ○ | ○ | ○ | ○ | ○ | ○ | — | ○ |

<Evaluation>:

Hereinafter, an evaluation of the Example 6 series (two-ply tissues) is shown.

Tensile Strength:

When Examples (6-1 to 6-7) are compared with the dry-embossed article (Comparative Example 6-2), then the Examples are higher in tensile strength (N). Each of Examples (6-5 to 6-7) provided with carboxymethyl cellulose sodium as the adhesive component is optimized in respect to the amount of the provided adhesive component and is therefore enhanced in the strength while maintaining the fluffy feel, when compared with Examples (6-2 to 6-4) unprovided with the adhesive component.

Apparent Density:

When Examples (6-1 to 6-7) are compared with the unembossed article (Comparative Example 6-1) and the dry-embossed article (Comparative Example 6-2), then the apparent density is smaller in the following order: Examples<dry-embossed article<unembossed article. Each of Examples (6-5 to 6-7) provided with carboxymethyl cellulose sodium as the adhesive component is smaller in apparent density than Examples (6-2 to 6-4) unprovided with the adhesive component.

Softness:

The embossed articles (Examples 6-1 to 6-7 and Comparative Example 6-2) are high in measured value on the whole. Its reason is that their surface embossed shapes resist sliding.

Amount of Oil Retained:

The amount of oil retained is enhanced in the following order: Examples>dry-embossed article>unembossed article.

Rate of Oil Absorption:

The rate of oil absorption is more excellent in the following order: Examples>dry-embossed article>unembossed article.

Fluffy Feel:

All the Examples are excellent in the fluffy feel. Examples (6-3, 6-4, 6-6, 6-7) provided with the softening component (stearyl alcohol) are particularly high in the evaluation of the fluffy feel.

Moist Feel:

Examples provided with the moisture-retaining component are more excellent in the moist feel than Examples unprovided therewith.

EXAMPLE 7

A raw crepe paper was made in the same way as of Example 1. The obtained raw crepe paper had a basis weight of 12.0 g/m$^2$ and a crepe ratio of 18%. The surface of this dry-conditioned raw crepe paper was sprayed with a solution containing an assistant agent and water shown in Table 8 to thus put the raw crepe paper in a wet condition, and then, in the same way as of Example 1, the raw crepe paper was embossed and made into three-ply to thus obtain crepe papers of Examples 7-1 to 7-7. As to the assistant agent and the emulsifier, the same as of Example 6 are used in the same way.

COMPARATIVE EXAMPLE 7

In Comparative Examples 7-1 and 7-2, crepe papers were obtained in the same way as of Comparative Examples 6-1 and 6-2 except that the raw crepe paper of Example 7 was used as the raw crepe paper and made into three-ply.

The evaluation results are shown in Table 8. The amounts of the assistant agent and of water have the same meaning as of Table 7. The evaluation results are also shown in the lower portion of Table 8.

TABLE 8

<Comparison of performance: impregnation (2) of assistant agent>:

| | Example | | | | Example | | | Comparative Example | |
|---|---|---|---|---|---|---|---|---|---|
| No. | 7-1 | 7-2 | 7-3 | 7-4 | 7-5 | 7-6 | 7-7 | 7-1 | 7-2 |
| Water | 20 | 20 | 20 | 20 | 20 | 20 | 20 | 0 | 0 |
| Glycerol | 0 | 10 | 0 | 10 | 10 | 0 | 10 | 0 | 0 |
| Emulsifier | 0 | 0 | 0.3 | 0.3 | 0 | 0.3 | 0.3 | 0 | 0 |
| Stearyl alcohol | 0 | 0 | 1 | 1 | 0 | 1 | 1 | 1 | 1 |
| CMC-Na | 0 | 0 | 0 | 0 | 0.1 | 0.1 | 0.1 | 0 | 0 |
| Isopropyl alcohol | 0 | 0 | 0 | 0 | 0 | 0 | 0 | 20 | 20 |
| Embossed shapes | ○ | ○ | ○ | ○ | ○ | ○ | ○ | — | Δ |
| Tensile strength (N) | 3.28 | 2.89 | 3.01 | 2.78 | 3.39 | 3.48 | 3.15 | 3.23 | 2.62 |
| % | 1.55 | −10.53 | −6.81 | −13.93 | 4.95 | 7.74 | −2.48 | | −18.89 |
| Breaking length (km) | 0.585 | 0.469 | 0.530 | 0.445 | 0.550 | 0.612 | 0.504 | 0.570 | 0.463 |
| Apparent density (g/cm$^3$) | | | | | | | | | |
| without load | 0.063 | 0.066 | 0.061 | 0.065 | 0.054 | 0.050 | 0.058 | 0.092 | 0.068 |
| % | −31.52 | −28.26 | −33.70 | −29.35 | −41.30 | −45.65 | −36.96 | | −26.09 |
| under load | 0.086 | 0.090 | 0.084 | 0.088 | 0.076 | 0.074 | 0.085 | 0.120 | 0.114 |
| % | −28.33 | −25.00 | −30.00 | −26.67 | −36.67 | −38.33 | −29.17 | | −5.00 |
| after compression: without load | 0.074 | 0.078 | 0.073 | 0.078 | 0.063 | 0.060 | 0.067 | 0.097 | 0.085 |
| % | −23.71 | −19.59 | −24.74 | −19.59 | −35.05 | −38.14 | −30.93 | | −12.37 |
| after compression: under load | 0.099 | 0.102 | 0.098 | 0.101 | 0.094 | 0.090 | 0.095 | 0.125 | 0.121 |
| % | −20.80 | −18.40 | −21.60 | −19.20 | −24.80 | −28.00 | −24.00 | | −3.20 |
| Amount of oil retained (times) | 11.54 | 9.26 | 9.66 | 9.64 | 9.45 | 9.51 | 9.04 | 7.25 | 8.13 |
| % | 59.17 | 27.72 | 33.24 | 32.97 | 30.34 | 31.17 | 24.69 | | 12.14 |
| Rate of oil absorption (s) | 1.5 | 1.2 | 1.8 | 1.9 | 1.5 | 1.5 | 1.8 | 3.8 | 2.8 |
| % | −60.53 | −68.42 | −52.63 | −50.00 | −60.53 | −60.53 | −52.63 | | −26.32 |
| Softness (mN/100 mm) | 40 | 36 | 37 | 33 | 45 | 51 | 41 | 29 | 38 |

TABLE 8-continued

<Comparison of performance: impregnation (2) of assistant agent>:

| | Example | | | | Example | | | Comparative Example | |
|---|---|---|---|---|---|---|---|---|---|
| No. | 7-1 | 7-2 | 7-3 | 7-4 | 7-5 | 7-6 | 7-7 | 7-1 | 7-2 |
| Fluffy feel | 3.0 | 3.2 | 3.5 | 3.8 | 3.3 | 3.9 | 4.0 | 1.5 | 2.1 |
| Moist feel | 1.7 | 3.3 | 2.7 | 3.9 | 3.0 | 2.5 | 3.9 | 1.3 | 1.5 |
| Processibility | ○ | ○ | ○ | ○ | ○ | ○ | ○ | — | ○ |

<Evaluation>:

The evaluation about the Example 7 series (three-ply tissues) was basically the same as the evaluation about the Example 6 series (two-ply tissues).

INDUSTRIAL APPLICATION

The embossed crepe paper gained according to the present invention can, for example, be used as a moisture-retaining tissue on which a moisture-retaining component is supported. It can provide a moisture-retaining tissue product of a high commercial value such that: fine embossed shapes can clearly be formed, and the bulkiness and the softness are excellent, and also a moist feel to the skin and the softness are provided due to the moisture-retaining component.

What is claimed is:

1. An embossed crepe paper, which is an embossed crepe paper obtained by embossing a raw crepe paper, wherein the raw crepe paper has a basis weight of 6 to 28 g/m$^2$ and a crepe ratio of 6 to 30% and includes wood pulp as not less than 70 weight % of raw fiber materials for the raw crepe paper, and wherein the embossed crepe paper has embossed shapes of 0.01 to 1.00 mm in height difference and 10 to 200 in number/cm$^2$, and contains a moisture-retaining component and has an apparent density (under load) of not more than 0.13 g/cm$^3$, a softness of not more than 40 mN/100 mm and a longitudinal tensile strength of 0.15 to 1.5 km in terms of breaking length, when measured in a two-ply state.

2. An embossed crepe paper which is an embossed crepe paper obtained by embossing a raw crepe paper, wherein the raw crepe paper has a basis weight of 6 to 28 g/m$^2$ and a crepe ratio of 6 to 30% and includes wood pulp as not less than 70 weight % of raw fiber materials for the raw crepe paper, and wherein the embossed crepe paper has embossed shapes of 0.01 to 1.00 mm in height difference and 10 to 200 in number/cm$^2$, and contains a moisture-retaining component and has three pieces of the raw crepe paper piled on each other an apparent density (under load) of not more than 0.11 g/cm$^3$ and a softness of not more than 60 mN/100 mm.

3. The embossed crepe paper according to claim 1 or 2, which has a smaller apparent density (under load) when measured in a two-ply state than when measured in a two-ply state of its unembossed raw crepe paper by at least 10% wherein the unembossed raw crepe paper contains the moisture-retaining component.

4. The embossed crepe paper according to claim 1 or 2, which exhibits a larger oil-retaining amount when measured in a two-ply state than when measured in a two-ply state of its unembossed raw crepe paper by at least 30% wherein the unembossed raw crepe paper contains the moisture-retaining component.

5. The embossed crepe paper according to claim 1 or 2, which is a tissue.

6. The embossed crepe paper according to claim 1 or 2, which is a roll-shaped wound product.

* * * * *